US005700126A

United States Patent [19]

Sohma et al.

[11] Patent Number: 5,700,126

[45] Date of Patent: Dec. 23, 1997

[54] SPOOL FEEDING METHOD AND SPOOL FEEDER

[75] Inventors: Masahiko Sohma; Osamu Zushi, both of Hiratsuka; Kenji Machijima; Hisao Tsutsumi, both of Tokyo, all of Japan

[73] Assignees: The Yokohama Rubber Co., Ltd.; Tokyo Rope Mfg. Co., Ltd., both of Tokyo, Japan

[21] Appl. No.: 354,859

[22] Filed: Dec. 9, 1994

[30] Foreign Application Priority Data

Dec. 28, 1993 [JP] Japan ..... 5-335961

[51] Int. Cl.[6] ..... B65G 60/00

[52] U.S. Cl. ..... 414/416; 414/279; 414/331; 414/911

[58] Field of Search ..... 414/277, 279, 414/331, 416, 609, 910, 911, 928, 929

[56] References Cited

U.S. PATENT DOCUMENTS

| | | | |
|---|---|---|---|
| 3,586,191 | 6/1971 | Brown, Jr. | 414/928 X |
| 3,773,190 | 11/1973 | Ishida et al. | 414/331 |
| 3,776,396 | 12/1973 | Burt et al. | 414/929 X |
| 4,773,810 | 9/1988 | Nishimura et al. | 414/331 |
| 4,783,021 | 11/1988 | Nagasawa | 414/331 X |
| 5,096,357 | 3/1992 | Galbani | 414/331 |
| 5,180,269 | 1/1993 | Nishioka | 414/331 |
| 5,247,889 | 9/1993 | Bertrams et al. | 414/331 X |
| 5,277,229 | 1/1994 | Kikuchi et al. | 414/331 X |
| 5,306,111 | 4/1994 | Higashiura | 414/416 |
| 5,360,306 | 11/1994 | Nakayama et al. | 414/331 |

*Primary Examiner*—James W. Keenan

*Attorney, Agent, or Firm*—Nikaido, Marmelstein, Murray & Oram LLP

[57] ABSTRACT

A spool feeding method comprising transferring a spool box having a plurality of spools with a cord wound on each of them, the spools being arranged with the axial direction of the spools vertical, to a spool takeout position, loading the spools onto a holding device from the spool box so as to change the axial direction of the spools from vertical to horizontal, and carrying the spools over to a creel stand and setting the spools on creel shafts on the creel stand. A spool feeder including at least one transfer mechanism for transferring a spool box to a spool takeout position, at least one loading mechanism for loading spools from the spool box onto a holding device at the takeout position, at least one moving mechanism capable of moving between a receiving position and the creel stand and a setting device for setting the spools held by the holding device to creel shafts laterally set on the creel stand.

16 Claims, 29 Drawing Sheets

SPOOL FEEDING METHOD AND SPOOL FEEDER

BACKGROUND OF THE INVENTION

The present invention relates to a method and a feeder for feeding a spool with a cord such as a steel cord wound on it to a creel stand, particularly to a spool feeding method and a spool feeder for automatically executing the feed steps from setting of a spool box storing a plurality of spools to transferring means through setting of the spools in the spool box on a plurality of creel shafts of a creel stand without human intervention.

In general, a steel cord used as an reinforcement cord of a tire is wound on spools which are stored in a spool box. To feed these spools having steel cord wound on them to a remote creel stand, a spool box storing the spools is transferred to a predetermined position by a transfer conveyor and loaded on a pallet transfer carriage there. Thereafter a worker transfers the carriage to the creel stand, takes the spools out of the spool box on the carriage one by one, and set them on creel shafts of the creel stand in order.

However, the weight of a spool with steel cord wound on it ranges between 10 and 40 kg. Thirty six to seventy two spools each having the above weight are stored in a box. Therefore, a spool box storing the spools has a considerable weight. Therefore, there is a problem that a lot of labor and time is necessary for a worker to move a pallet transfer carriage with a spool box mounted thereon.

Moreover, the operation for taking spools out of a spool box one by one and setting them on creel shafts of a creel stand in order takes a lot of labor and time. Therefore, there is a problem that the operation efficiency is very low.

SUMMARY OF THE INVENTION

It is an object of the present invention to provide a spool feeding method and a spool feeder which make it possible to automatically feed a spool having steel cord wound on it to a creel stand without human intervention and greatly improve the efficiency of spool feed operation.

The spool feeding method of the present invention for achieving the above object comprises the transfer step of transferring a spool box in which a plurality of spools having cord wound on each of them are stored by vertically arranging the axial directions of the spools up to a position for taking the spools out of the spool box, the loading step of loading the spools onto holding means on moving means from the spool box at the takeout position so that the axial directions of the spools are changed from vertical to horizontal, and the setting step of moving the moving means to transfer the spools held by the holding means to a creel stand and setting the spools on creel shafts horizontally set on the creel stand.

The spool feeder of the present invention comprises at least one transferring means for transferring a spool box in which a plurality of spools having cord wound on them are stored by vertically arranging the axial directions of the spools to a spool takeout position, at least one loading means for loading the spools onto holding means from the spool box at the takeout position so that the axial directions of the spools are changed from vertical to horizontal directions, at least one moving means capable of moving between the takeout position and a creel stand, and setting means for setting the spools held by the holding means mounted on the moving means on creel shafts laterally set on the creel stand.

The present invention makes it possible to automatically feed a plurality of spools stored in a spool box to a creel stand set at a remote position without human intervention and thereby greatly improve the efficiency of spool feed operation.

DETAILED DESCRIPTION OF THE PREFERRED EMBODIMENTS

Figure 1:
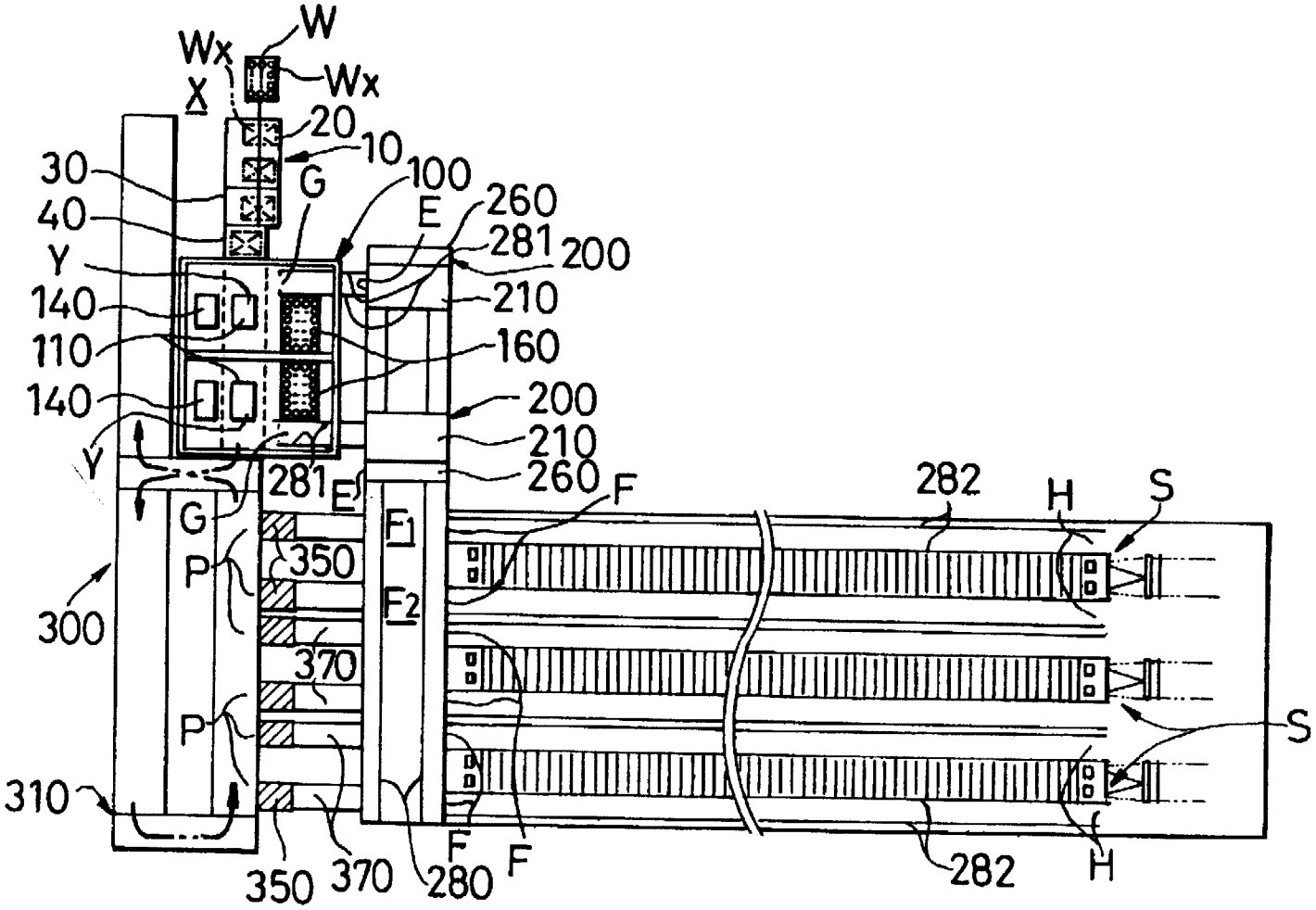
FIG. 1 is a schematic top view showing an arrangement of constituting means in the spool feeder of the present invention.

As shown in FIG. 1, the spool feeder of the present invention comprises transferring means 10 for transferring a spool box Wx storing spools W having cord such as steel cord each wound on them up to a spool takeout position Y, loading means 100 which is set adjacently to the takeout position Y to take the spools W cut of the spool box Wx for loading, and moving means 200 capable of moving between the loading means 100 and a plurality of creel stands S for feeding the cord wound on the spool W by holding the spool W. Moreover, collecting means 300 for collecting empty spools from the creel stands S to the spool throw-in port X of the transferring means 10 is set adjacently to the transferring means 10.

Figure 2:
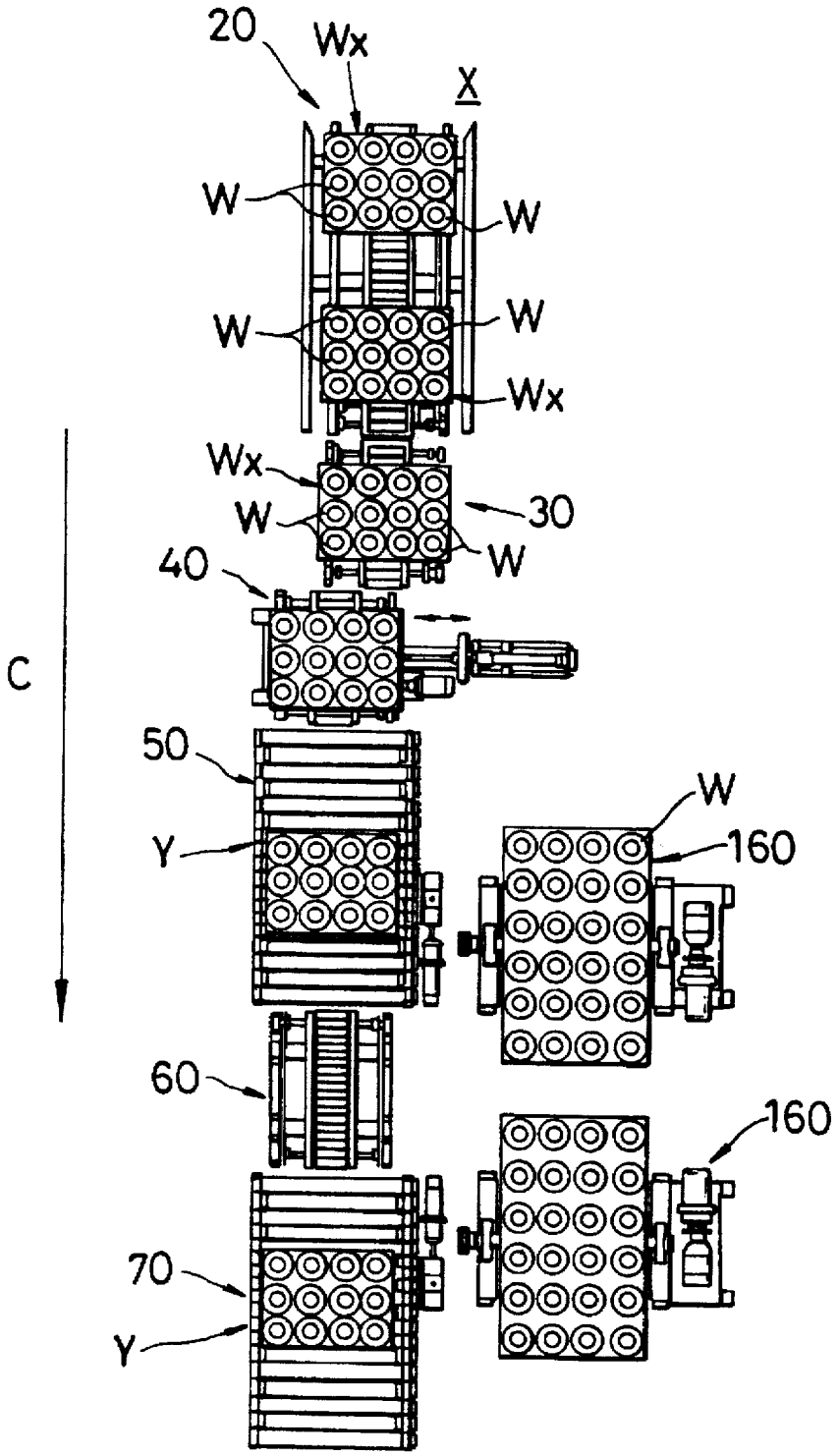
FIG. 2 is a schematic top view showing a transferring means for transferring spool boxes storing spools and a delivering means of the loading means in the spool feeder of the present invention.
Figure 3:
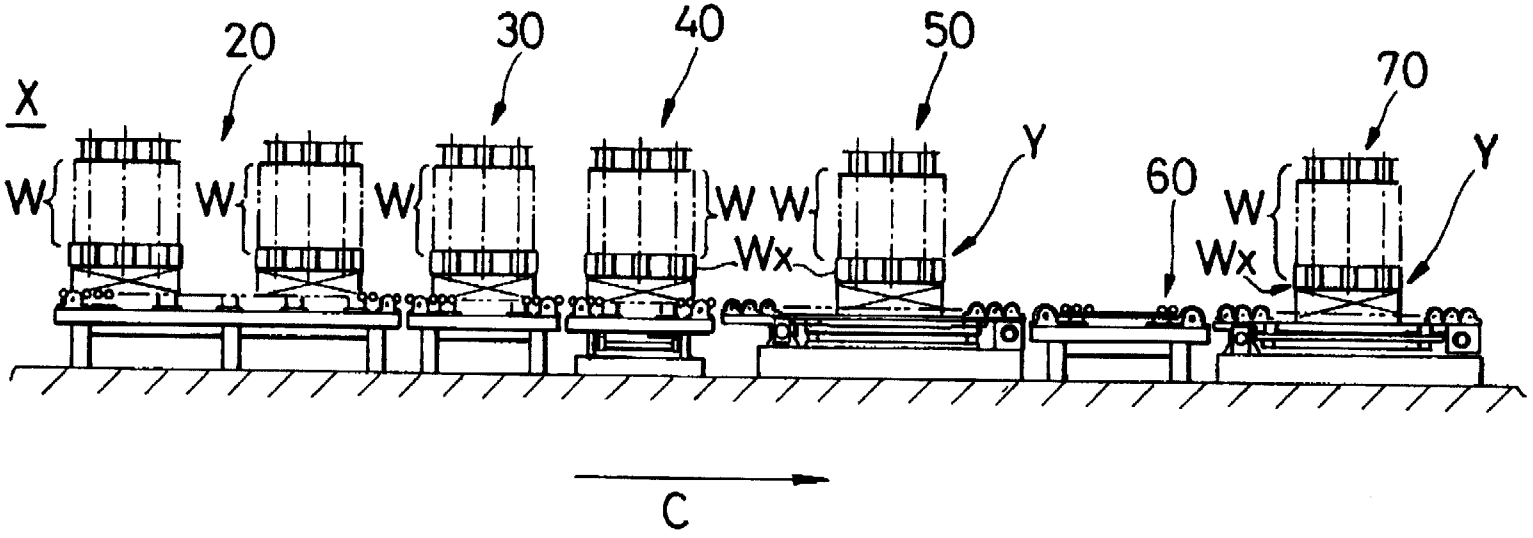
FIG. 3 is a left side view of FIG. 2.

As shown in FIGS. 2 and 3, the transferring means 10 comprises a plurality of conveyor systems 20, 30, 40, 50, 60, and 70 arranged in series so that the conveyor systems have the same transfer direction.

The first conveyor system 20 is set to the charging port X for charging the spool box Wx (FIG. 5) storing a plurality of spools W having cord n wound on them. Each spool W has flanges W2 at the both ends of a cylindrical portion W1 with the cord n wound on the cylindrical portion. The spools are arranged in the spool box Wx in multiple-row planes having the axial direction of the cylindrical portion W1 oriented vertically having the flanges W2 (in a height direction) stacked in multiple stages with partitions Wz therebetween (FIG. 5).

Figure 4:
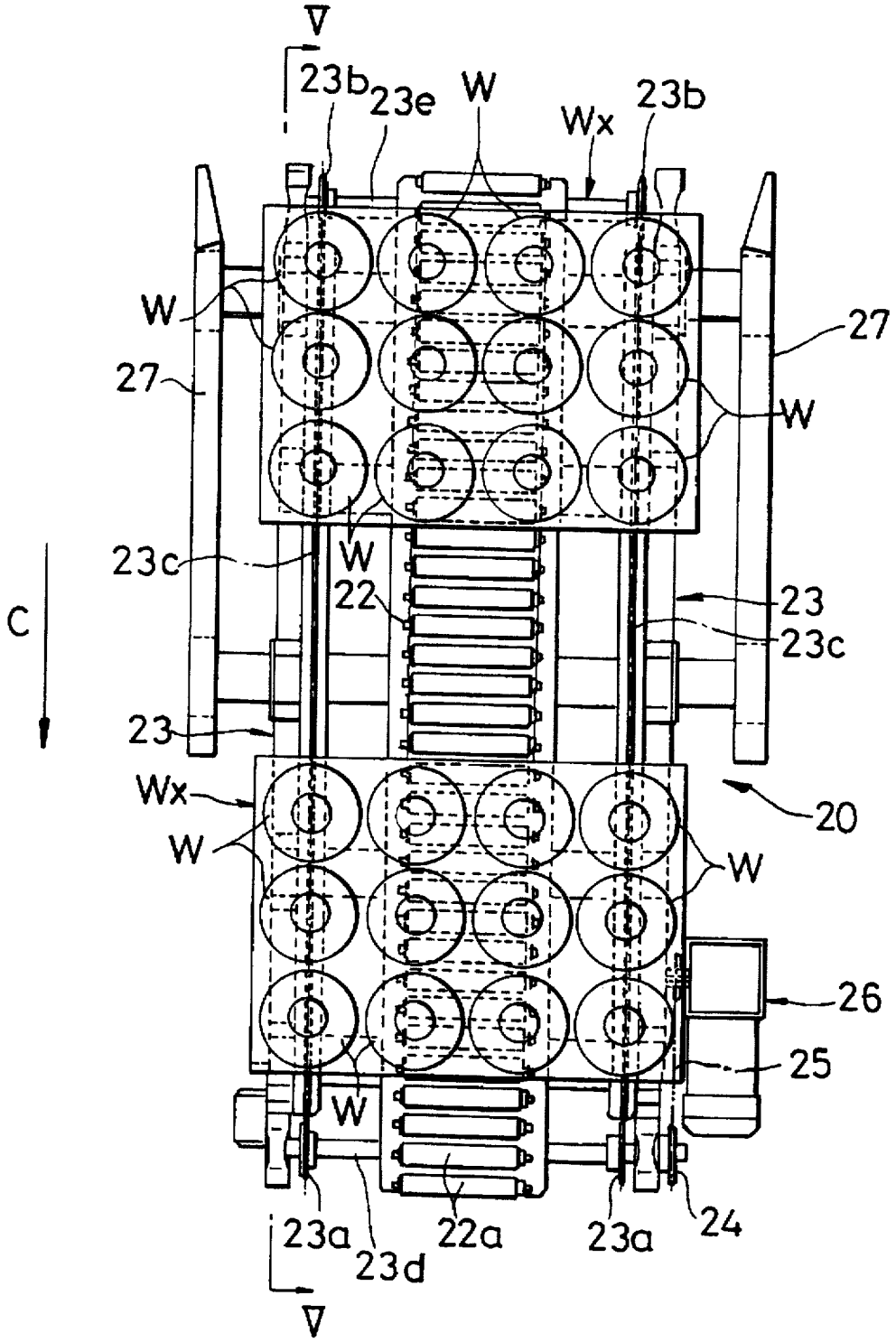
FIG. 4 is a top view showing a first conveyor system of the transferring means for transferring a spool box storing spools in the spool feeder of the present invention.
Figure 5:
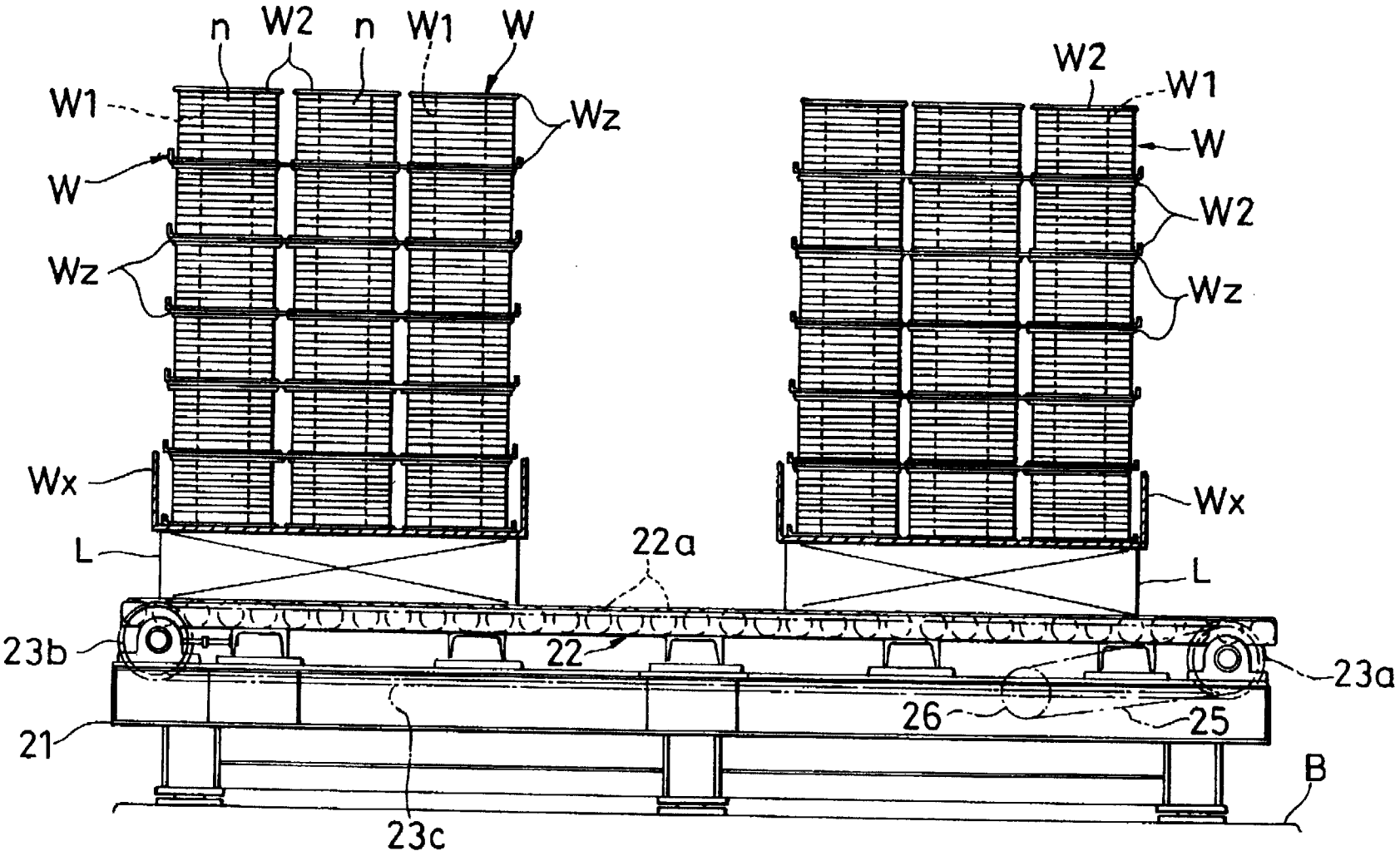
FIG. 5 is a side view taken along the line V—V of FIG. 4.

As shown in FIGS. 4 and 5, the conveyor system 20 has a first free roller conveyor 22 comprising a plurality freely rotating rollers 22*a* horizontally arranged in parallel along a transfer direction C and set on a support frame 21 set on a base B. A first chain conveyor 23 for transferring the spool box Wx is arranged adjacent to the free roller conveyor 22 along the transfer direction C.

The first chain conveyor 23 has a pair of transferring chains 23*c* positioned on both sides of the free conveyor 22 respectively, each passed around front and rear sprockets 23*a* and 23*b* secured to front and rear rotatably-supported rotary shafts 23*d* and 23*e* at the ends of the first free roller conveyor 22. The chains 23*c* are arranged so that the top of the chains 23*c* is approximately flush with the top of the free roller 22*a* of the first free roller conveyor 22 to form a transfer face.

A driving sprocket 24 is secured to one end of a rotary shaft 23*d* at the front side of the transfer direction. A driving motor 26 is set to one side of the chain conveyor 23. The driving motor 26 drives the chain Z5 passed around on the sprocket 24 and the rotary shaft 23*d* rotates to drive the transferring chains 23*c*. A guide frame 27 is set on both sides of the support frame 21 at the charging side of the first conveyor system 20.

The second conveyor system 30 is set next to the first conveyor system 20 at the transfer direction side of the conveyor system 20. A correcting means 80 for correcting the orientation of the spool box Wx with respect to the transfer direction C is arranged on the conveyor system 30 so that the box Wx moves along the transfer direction C positioned longitudinally aligned in the transfer direction.

Figure 6:
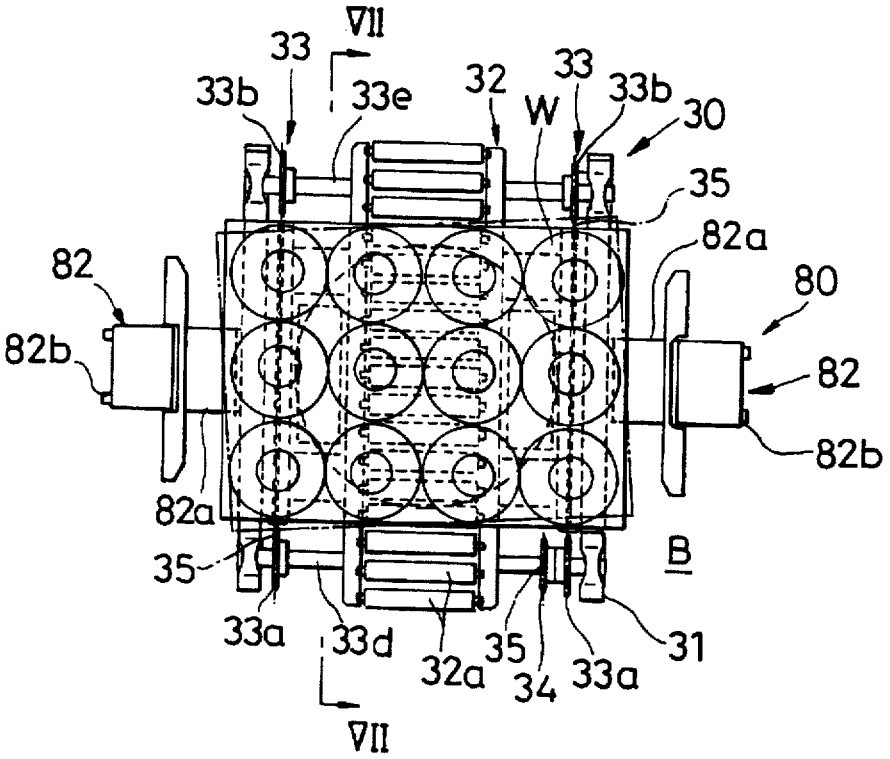
FIG. 6 is a top view showing a second conveyor system of the transferring means and a correcting means in the spool feeder of the present invention.
Figure 7:
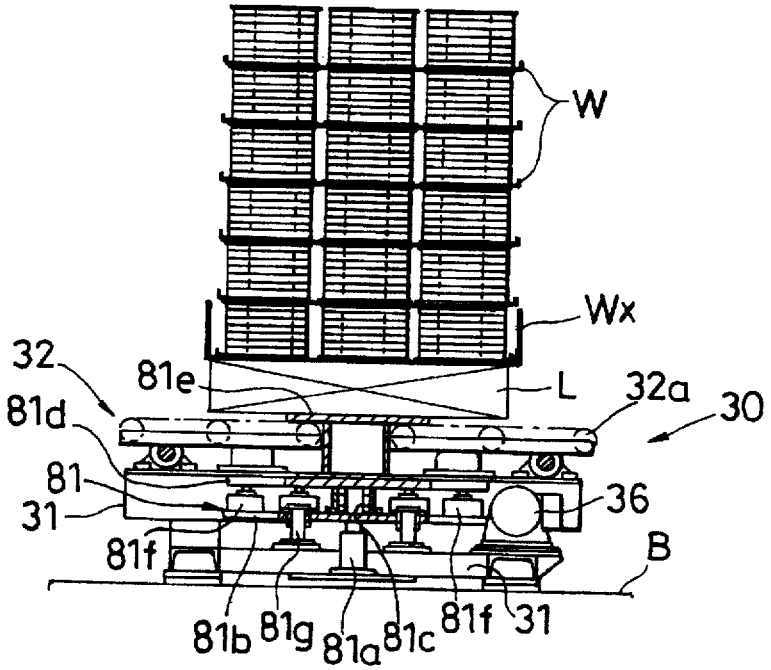
FIG. 7 is a side view taken along the line VII—VII of FIG. 6.
Figure 8:
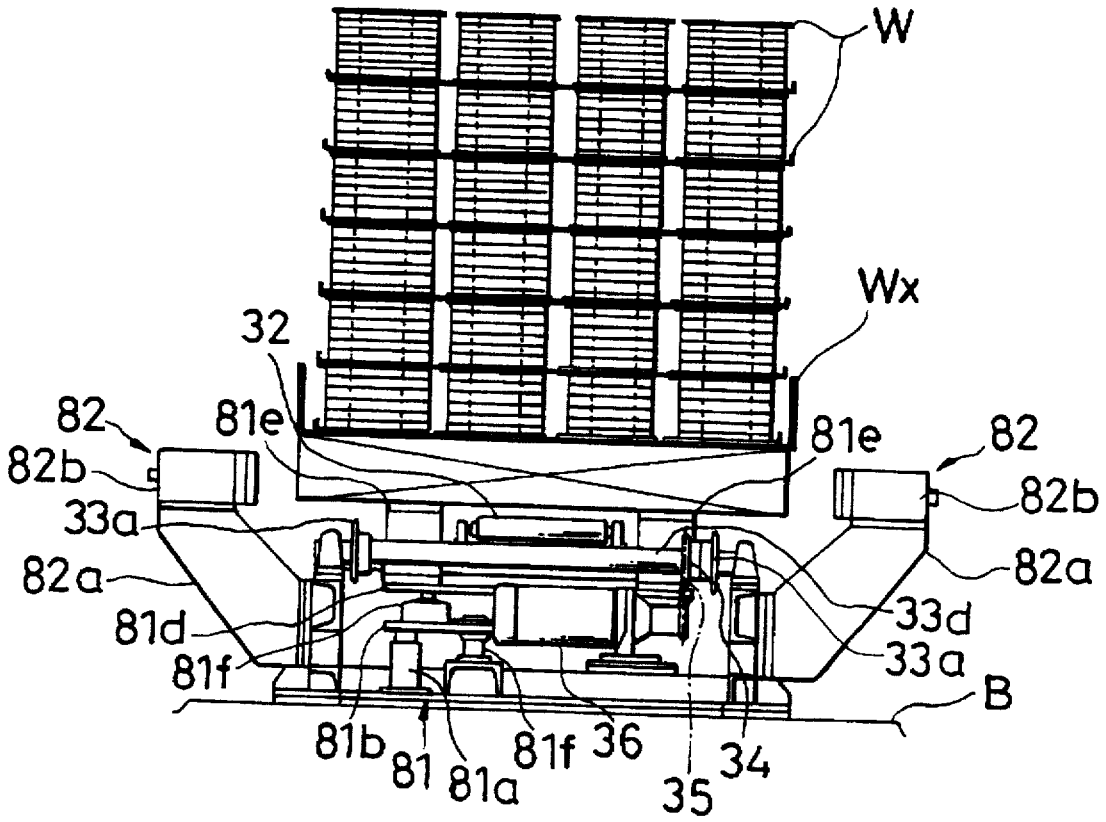
FIG. 8 is a front view of FIG. 6.

The second conveyor system 30 is constituted similarly to the first conveyor system 20 and, as shown in FIGS. 6 to 8, has a second free roller conveyor 32 comprising a plurality of freely rotating rollers 32*a* horizontally arranged in parallel along the transfer direction C set on a support frame 31 set on the base B. A second chain conveyor 33 for transferring the spool box Wx is arranged adjacently to the second free roller conveyor 32 along the transfer direction C.

The second chain conveyor 33 has a pair of transferring chains 33*c* on both sides of the second free conveyor 32, each passed around front and rear sprockets 33*a* and 33*b* secured to rotatably-supported front and rear rotary shafts 33*d* and 33*e* at the ends of the second free roller conveyor 32. The chains 33*c* are arranged so that the top of the chains 33*c* is approximately flush with the top of the free rollers 32*a* of the second free roller conveyor 32.

A driving sprocket 34 is secured to one end of the rotary shaft 33*d* at the front side in the transfer direction. A driving motor 36 set under the second free roller conveyor 32 drives a chain 35 passed around the sprocket 34. Moreover, the rotary shaft 33*d* rotates to drive the transferring chains 23*c* of both sides.

The correcting means 80 comprises lifting means 81 for lifting the spool box Wx upward from the top of the second chain conveyor 33 and the top of the second free roller conveyor 32 which are formed at approximately the same height and a pair of pressing means 82 for pressing against the lateral sides of the spool box Wx when it is lifted by the lifting means 81 to correct the orientation of the spool box Wx (if needed) to be aligned longitudinally with respect to the transfer direction.

The lifting means 81 has a lifting member 81*b* vertically movably supported by a pair of cylinders 81*a* set under the second free roller conveyor 32 in the transfer width direction. A discold turntable 81*d* is rotatably supported on the lifting member 81*b* through a bearing member 81*c* at its center. A pair of mounting sections 81*e* for mounting the spool box Wx protrude upward on both sides of the turntable 81*d* respectively. These mounting sections 81*e* protrude upward between each transferring chain 33*c* of the second chain conveyor 33 and the second free roller conveyor 32 beyond the transfer surface so as to mount the spool box Wx on the upper portion and lift it. A plurality of guide ball members 81f for supporting the bottom of the turntable 81d are arranged on a circle about the bearing member 81c on the lifting member 81b. A guide rod 81g is provided for guiding the vertical movement of the lifting member 81b vertically set on the support frame 31.

The pressing means 82 has two pressing cylinders 82b, each of which is fixed on the front end of a bracket 82a protruded from each side of the support frame 31 of the second conveyor system 30. When the cylinders 82b operate, the front end of a cylinder rod presses both sides of a mount L mounting the spool box Wx. When the lifting means 81 lifts the spool box Wx upward, the cylinders 82b of the pressing means 82 operate and the front end of the rod presses against both sides of the mount L. Thereby, the sides of the mount L (spool box Wx) are set to be parallel to the transfer direction C.

The third conveyor system 40 is set nest to the second conveyor system 30 at the downstream side in the transfer direction. The third conveyor system 40 contains width positioning means 90 for laterally positioning the spool box Wx (already corrected in the longitudinal direction) in the cross direction of the transfer direction C.

Figure 9:
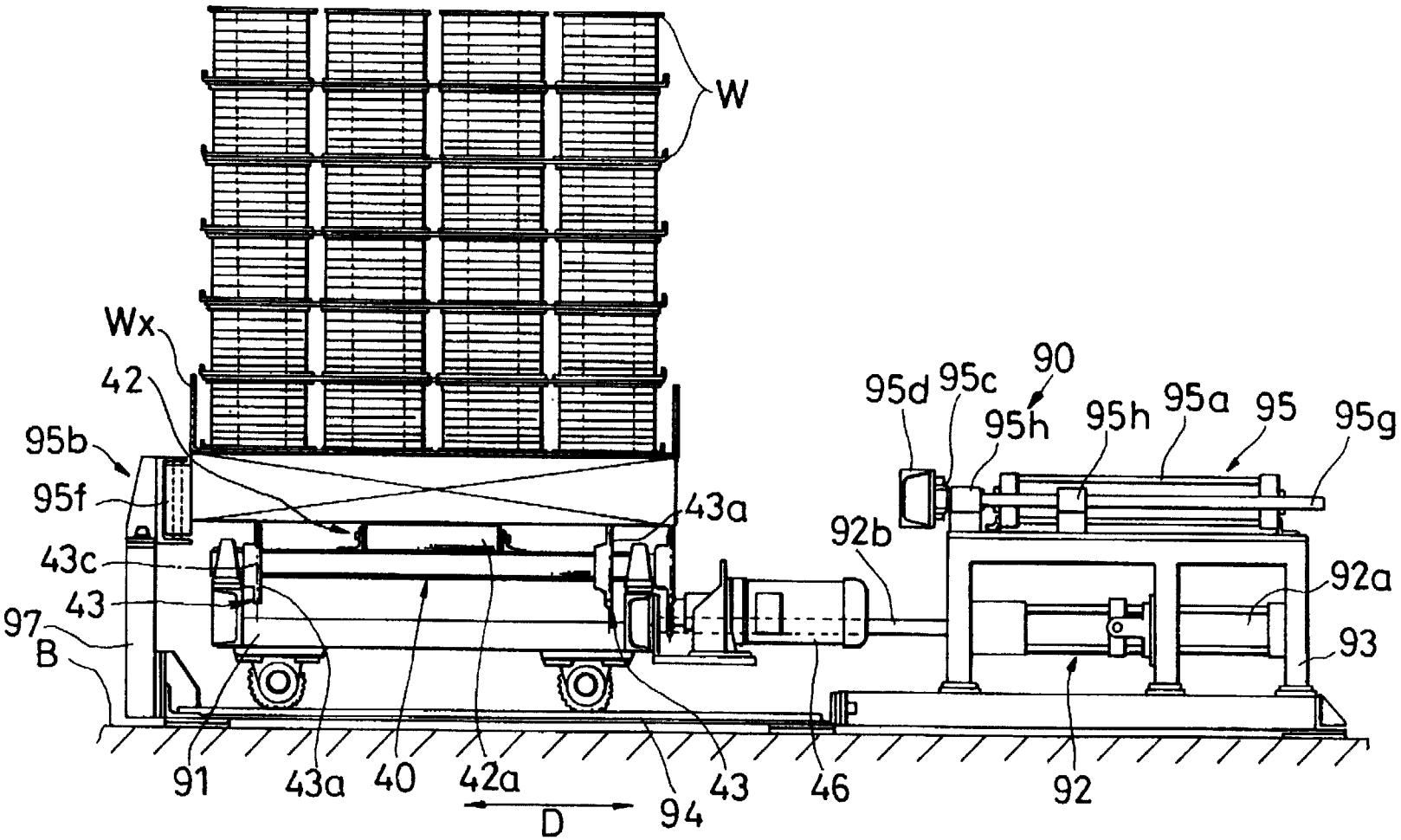
FIG. 9 is a front view showing a third conveyor system of the transferring means and a width positioning means in the spool feeder of the present invention.

As shown in FIGS. 2 and 9, the third conveyor system 40 has a third free roller conveyor 42 comprising a plurality of freely rotating rollers 42a horizontally arranged in parallel along the transfer direction on a carriage 91 of width positioning means 90, which carriage 91 is reciprocatingly movable in a direction D perpendicular to the transfer direction. A third chain conveyor 43 for transferring the spool box Wx is arranged next to the third free roller conveyor 42 along the transfer direction.

The third chain conveyor 43 has a pair of transferring chains 43c on both sides of the third free roller conveyor 42, each passed around rotatably-supported front and rear sprockets 43a respectively. The chains 43c are arranged so that the top of the chains 43c are approximately flush with the top (transfer face) of the free rollers 42a.

A driving motor 46 is set to one side of the carriage 91 so that the transferring chains 43c are driven by the motor 46.

The width positioning means 90 comprises the carriage 91 running on a base plate 94 laid on the base B and positioning means 95 for positioning a spool box Wx mounted on the third free roller conveyor 42 in a transfer width direction perpendicular to the transfer direction C by moving the carriage 91 serving as moving means.

A locking means 92 for locking the carriage 91 at a predetermined position is provided at one side of the carriage 91 in its moving direction. The locking means 92 has a locking cylinder 92a horizontally set to a support frame 93 set on the base B. The front end of a retractable rod 92b of the cylinder 92a is connected to one side of the carriage 91.

Side positioning means 95 comprises a positioning cylinder 95a set on the support frame 93 at one side of the carriage 91 and positioning roller means 95b arranged at the other side (left side in FIG. 9) of the carriage 91. A rod 95c of the positioning cylinder 95a can horizontally be extended and retracted along the moving direction of the carriage 91 independently of the carriage 91. A pressing member 95d for pressing the lateral side of the mount L mounting the spool box Wx on the third free roller conveyor 42 is provided on the front end of the rod 95c. The positioning roller means 95b comprises a plurality of freely rotating rollers 95f vertically supported on a vertically-set supporting member 97 and arranged in parallel along the transfer direction. First guide rods 95 having their front ends secured to the pressing member 95d are arranged on the support frame 93 at both sides of the positioning cylinder 95a through a support guide 95h so that the first guide rods 95 are reciprocated in the moving direction of the rod 95c together with the rod 95c.

When the spool box Wx mounted on the mount L is transferred onto the third free roller conveyor 42, the rod 95c of the positioning cylinder 95a extends to press the lateral side of the mount L and moves the spool box Wx together with the cardage 91 until the mount L contacts the positioning rollers 95f. At the same time, the locked state of the locking cylinder 92a is released and the rod 92b also extends. When the mount L contacts the positioning roller means 95b, positioning of the spool box Wx is completed. Then, the locking cylinder 92a is locked again. This ensures that the spool box is correctly positioned laterally.

Figure 10:
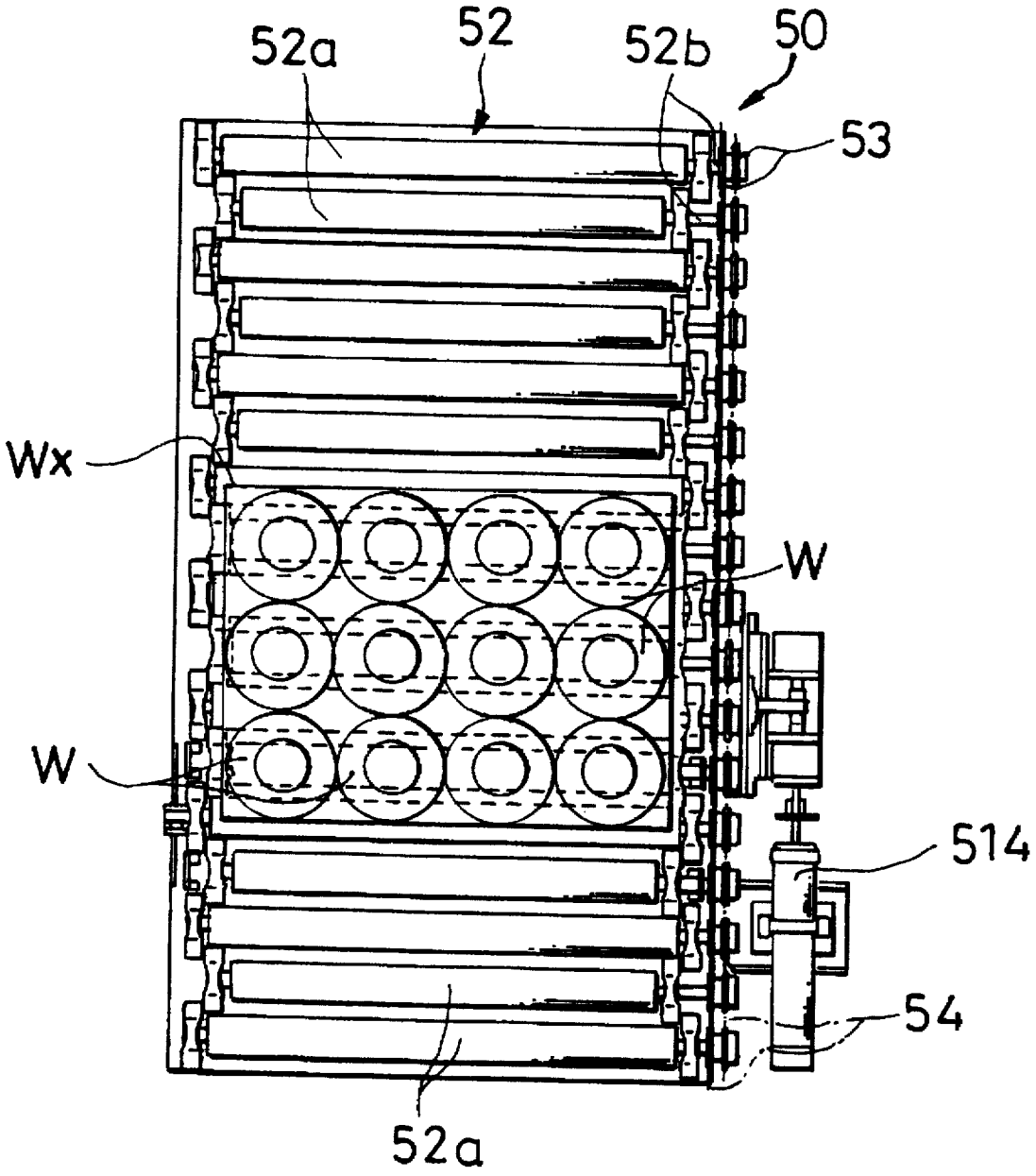
FIG. 10 is a top view showing a fourth conveyor system of the transferring means in the spool feeder of the present invention.
Figure 11:
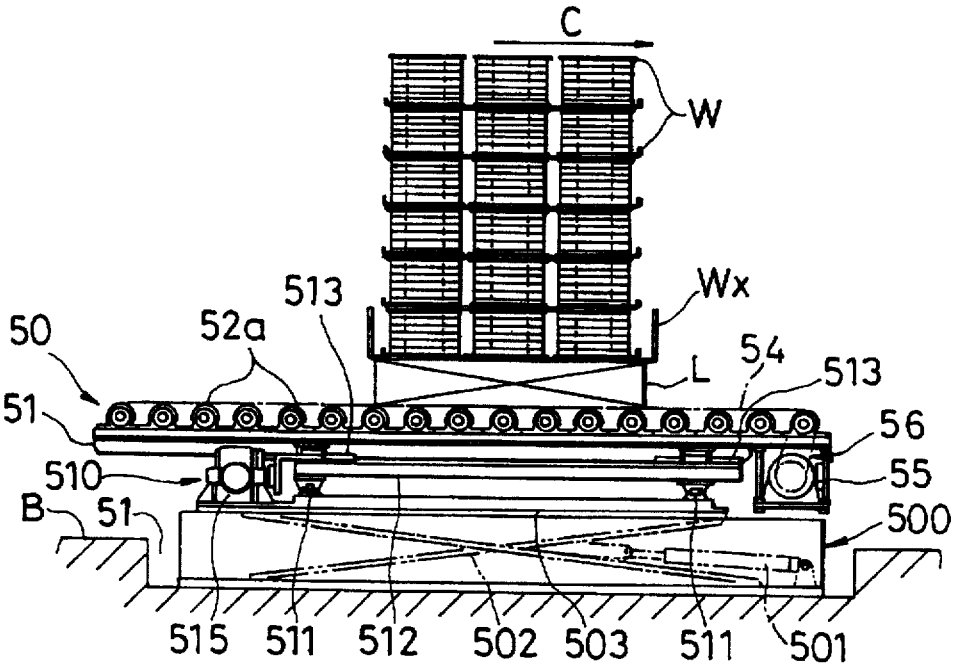
FIG. 11 is a side view of the fourth conveyor system provided on lifting means through position adjusting means.

As shown in FIG. 2, the fourth, fifth, and sixth conveyor systems 50, 60, and 70 are arranged in that order next to the third conveyor system 40 at the downstream side in the transfer direction C along the transfer direction. The fourth conveyor system 50 and sixth conveyor system 70 are arranged at two takeout positions Y provided for taking the spools W out of the spool box Wx respectively, and having the same constitution shown in FIGS. 10 and 11. Therefore, the constitution of the fourth conveyor system 50 is described below but that of the sixth conveyor system 70 is omitted.

The fourth conveyor system 50 has a driven roller conveyor 52 comprising a plurality of rotatable rollers 52a horizontally arranged in parallel along the transfer direction C. A sprocket 53 is attached to one end of each roller shaft 52b rotatably supporting each roller 52a. A chain 54 engages all of these sprockets 53. A driving motor 55 for rotating the chain 54 is set to the end in the transfer direction, which drives the chain 54 through a driving-force transfer mechanism 56 comprising a chain, a sprocket and the like. In this manner, each roller 52a is rotated by the chain 54. The fourth roller conveyor 52 is set on a position adjusting means 510 which in turn is mounted on a lifting means 500.

The lifting means 500 is set on a recessed portion 51 of the base B so as to protrude upward from the recessed portion 51 and has an X-linkage 502 which is vertically moved by a cylinder 501. A support plate 503 is set on the top of the linkage 502. The position adjusting means 510 is set on the support plate 503.

The position adjusting means 510 has a moving plate 512 which reciprocates in the transfer width direction within a predetermined adjustment interval along a pair of first guide rails 511 arranged in a direction perpendicular to the transfer direction C on the support plate 503. A pair of second guide rails 513 with a predetermined length are set on the moving plate 512 at the front and the rear along the transfer direction C. A conveyor frame 51a of the roller conveyor 52 is set along the second guide rails 513 so that it can reciprocatingly be moved within a predetermined adjustment interval along the transfer direction C. A first power cylinder 514 is set on the moving plate 512. The first cylinder 514 moves the roller conveyor 52 along the transfer direction C. A second driving cylinder 515 is set on the support plate 503. The second driving cylinder 515 moves the moving plate 512 along a direction perpendicular to the transfer direction C.

Figure 12:
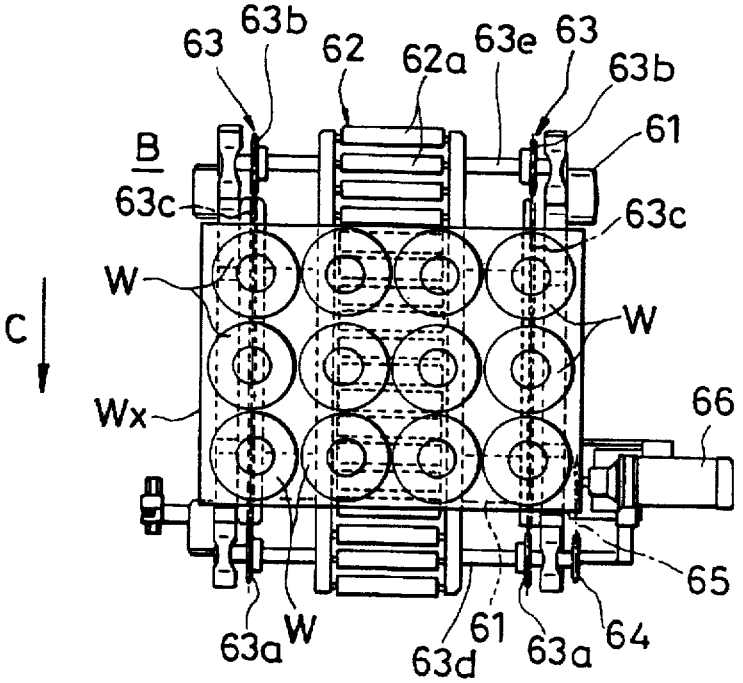
FIG. 12 is a top view showing a fifth conveyor system of the transferring means in the spool feeder of the present invention.

The fifth conveyor system 60 connects the fourth conveyor system 50 and the sixth conveyor system 70 located at the two takeout positions Y. The fifth conveyor system, as shown in FIG. 12, has a fourth free roller conveyor 62 set on the support frame 61 set to the base B and comprising a plurality of freely rotating rollers 62a which are arranged horizontally along the transfer direction C. A fourth chain conveyor 63 for transferring the spool box Wx is arranged next to the fourth free roller conveyor 62 along the transfer direction C.

The fourth chain conveyor 63 has a pair of transferring chains 63*c* on both sides of the fourth free roller conveyor 62, each wound on front and rear sprockets 63*a* and 63*b* secured to front and rear rotatably supported rotary shafts 63*d* and 63*e* and is set so that the top of the chains 63 is approximately flush with the top of the free rollers 62*a* of the fourth free roller conveyor 62.

A driving sprocket 64 is secured to one end of the rotary shaft 63*d* at the front side in the transfer direction. A driving motor 66 is set to one side of the fourth chain conveyor 63. The driving motor 66 drives a chain 65 passed around the sprocket 64 to rotate the transferring chain 63*c* through the rotary shaft 63*d*.

The above loading means 100 comprises taking-out means 110 for taking the spools W transferred to the takeout position Y out of the spool box Wx, a removing means 140 arranged at one side of the taking-out means 110 to remove the partitions Wz which are arranged between spools W, and a delivering means 160 arranged at the other side of the taking-out means 110 relative to the removing means 140 to deliver the spools W to the moving means 200 by rotating a mounting means for mounting the spools W taken out by the taking-out means 110.

Figure 13:
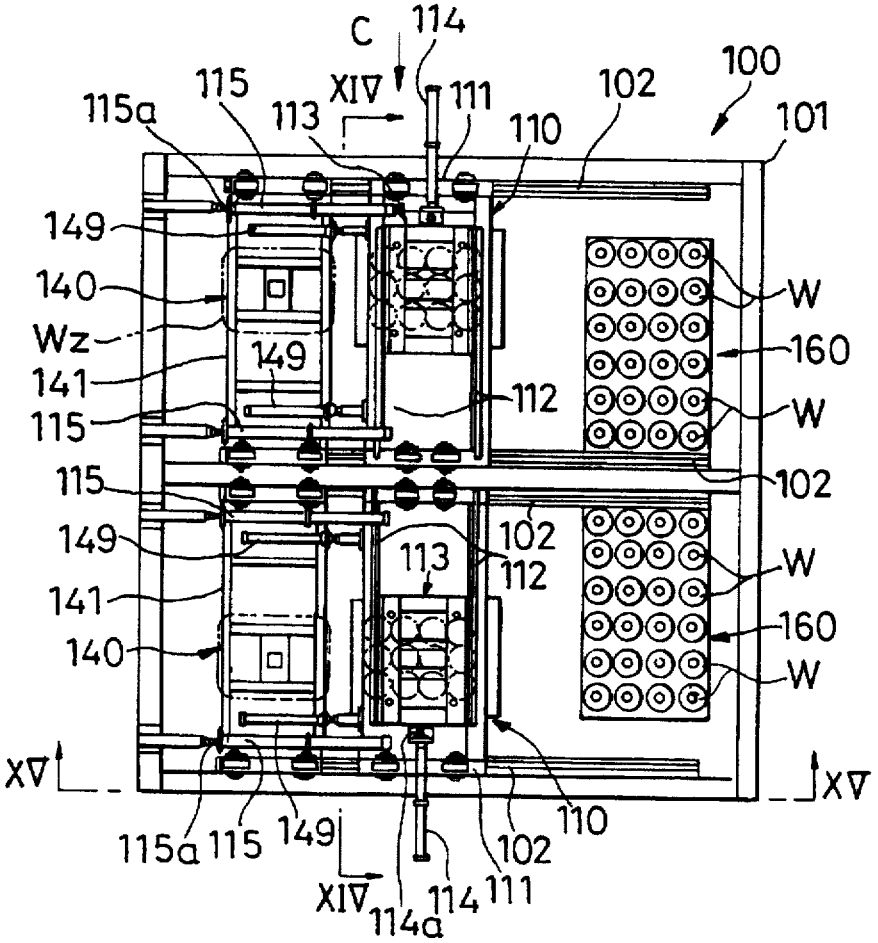
FIG. 13 is a schematic top view showing a loading means in the spool feeder of the present invention.
Figure 14:
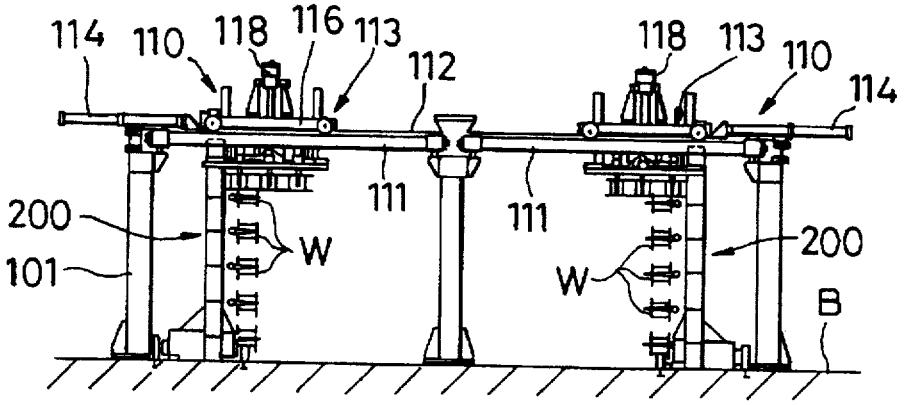
FIG. 14 is a schematic side view taken along the line XIV—XIV of FIG. 13.
Figure 15:
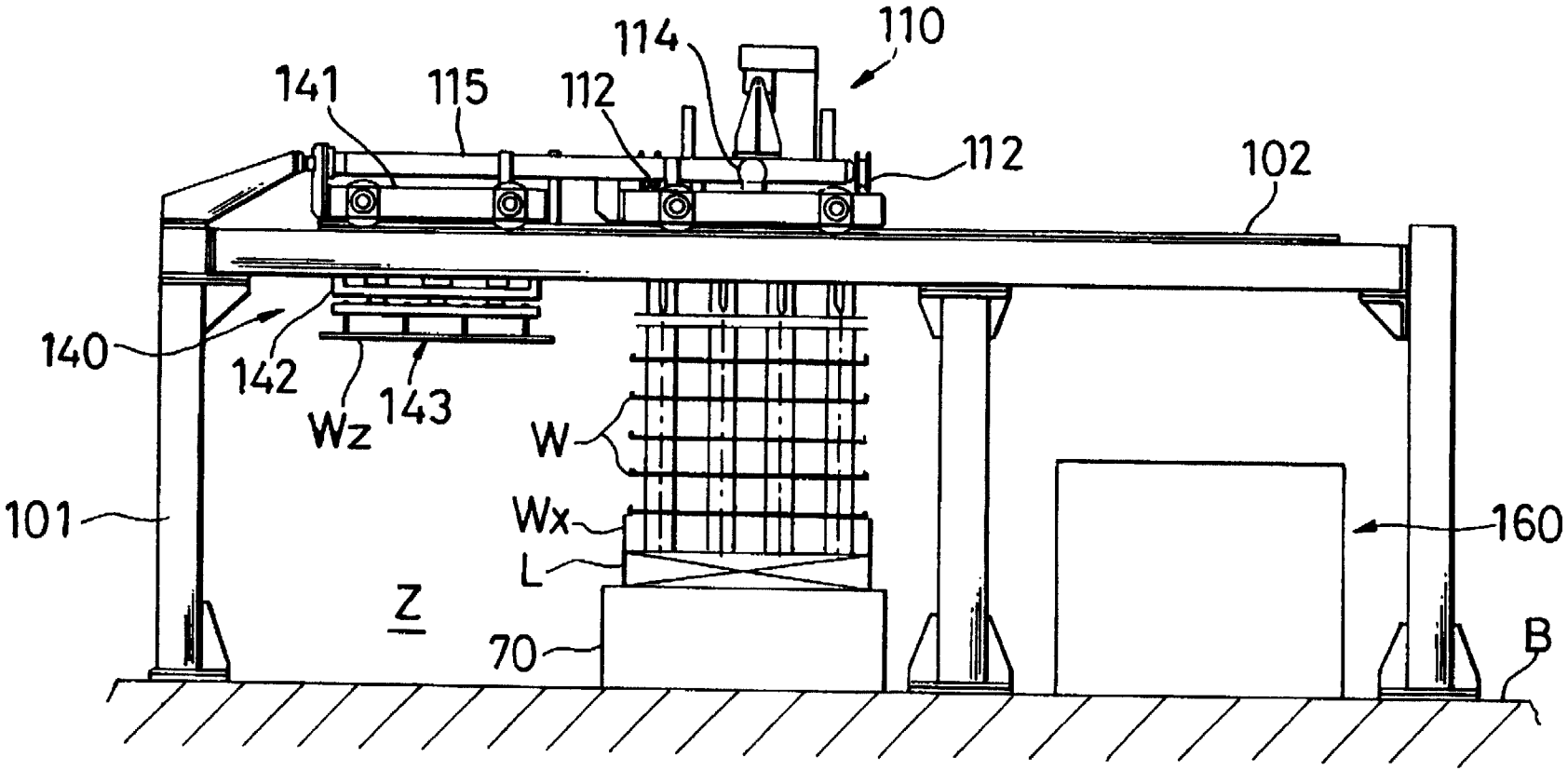
FIG. 15 is a schematic side view taken along the line XV—XV of FIG. 13.

As soon in FIGS. 13 to 15, the taking-out means 110 and the removing means 140 are set on a support frame 101 erected above the fourth, fifth, and sixth conveyors 50, 60, and 70. Because two takeout positions Y are provided, two each of the taking-out means 110 and the removing means 140 are also provided correspondingly to the take-out positions. Therefore, one taking-out means 110 and removing means 140 are described below but description of the other taking-out means 110 and removing means 140 is omitted though the same reference numerals are given to them.

The taking-out means 110 has a first moving frame 111 which runs on a pair of third guide rails 102 horizontally arranged on the support frame 101 along a direction perpendicular to the transfer direction C. A pair of fourth guide rails 112 are arranged on the moving frame 111 in parallel in a direction perpendicular to the third guide rails 102. A holding and running section 113 which runs holding the spools W is set on the fourth guide rails 112 so as to move along the fourth guide rails 112.

A driving cylinder 114 for running the holding and running section 113 is set on the lateral (bottom in FIG. 14) side of one fourth guide rail 102 on the moving frame 111. The front end of a retractable rod 114*a* of the cylinder 114 is connected to one side of the holding and running section 113. Two first running cylinders 115 for running the first moving frame 111 are set between the left sides of the first moving frame 111 and the support frame 101 in FIG. 13. These first running cylinders 115 extend or shorten their rods 115*a* and the first moving frame 111 runs along the third guide rails 102.

Figure 16:
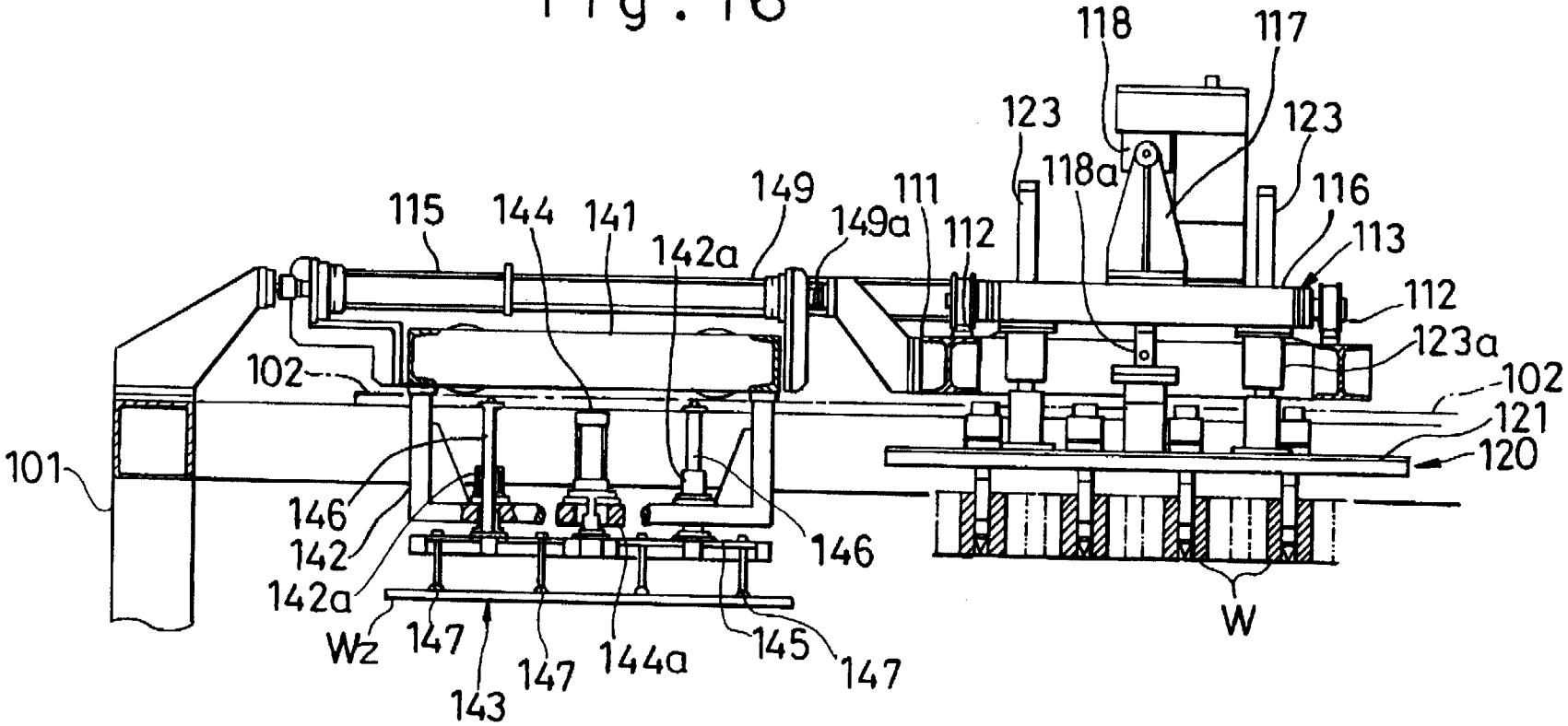
FIG. 16 is a schematic partial sectional front view showing a spool taking-out means and a partition removing means of the loading means.

As shown in FIG. 16, the holding and running section 113 has a running frame 116 which runs on the fourth guide rails 112. A power cylinder 118 is set on the running frame 116 through a bracket 117 with its rod 118*a* facing downward. A holding section 120 for holding the spools W is suspended on the front end (bottom) of the rod 118*a*.

Figure 17:
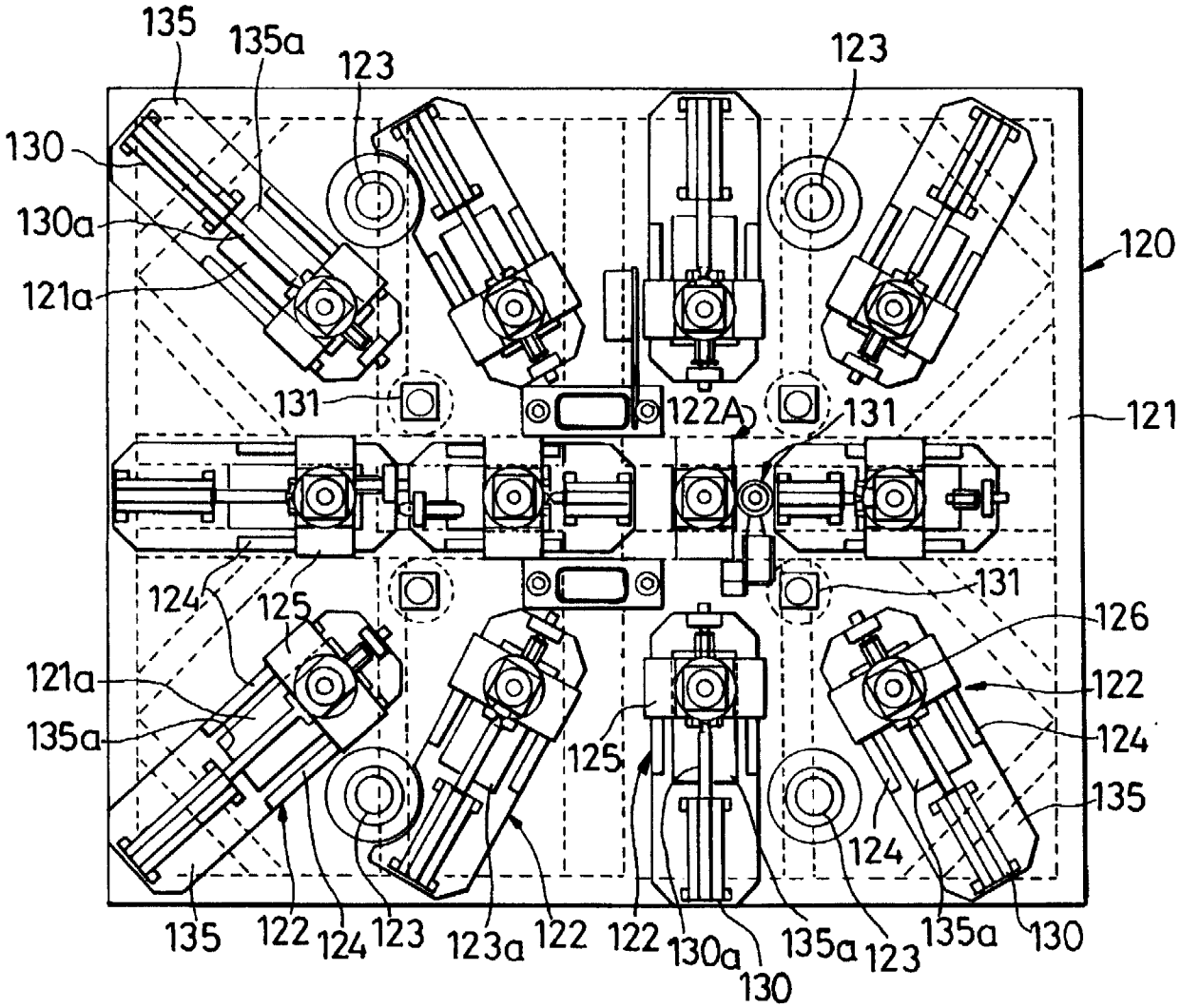
FIG. 17 is a top view showing a holding section of the spool taking-out means.

The holding section 120 has a first flat plate member 121 horizontally fixed to the front end of the rod 118*a*. As shown in FIG. 17, plural first holding means 122 (twelve first holding means in FIG. 17) according to the number of spools in one level of spools W arranged in the spool box Wx are set on the first flat plate member 121. A plurality of second guide rods 123 are vertically set on the first plate member 121. Each second guide rod 123 is inserted through a cylindrical guide 123*a* set on the running frame 116. The top of each second guide rod 123 extends above the running frame 116.

Each first holding means 122 (excluding one first holding means 122A arranged at the center) has a flat base plate 135 with a hole 135*a* formed in it. The base plate 135 is secured on the plate member 121 by aligning the hole 135*a* with a hole 121*a* formed in the plate member 121. A pair of fifth guide rails 124 are arranged in parallel on each base plate 135 at both sides of the hole 135*a*, one each as shown in FIG. 17. Each moving member 125 reciprocating along the fifth guide rails 124 is set on them. Holding means 122A set at the center is secured to the first flat plate member 121, which has the same constitution as that provided on the moving means described below.

A cylinder 126 having a cylindrical rod 126*a* which can be inserted into a longitudinal bore W3 of the cylindrical portion W1 and which protrudes downward beyond the plate member 121 is vertically provided on each moving member 125. A holding rod 127 secured to the cylinder 126 is provided on the cylindrical rod 126*a* so that it protrudes downward beyond the end of the rod 126*a*. A cap member 128 which has an outside diameter larger than that of the holding rod 127 and can be inserted into the bore W3 of the spool W is secured to the bottom of the holding rod 127. Moreover, an annular press-contact member 129 made of elastic rubber or the like is provided on the outer periphery of the holding rod 127 between the cap member 128 and the cylindrical rod 126*a*. When the rod 126*a* extends to press the press-contact member 129, the press-contact member 129 inflates in its radius direction and is pressed against the inner wall of the bore W3 of the spool W. In this manner, the spool W can be held from the inside.

Figure 18:
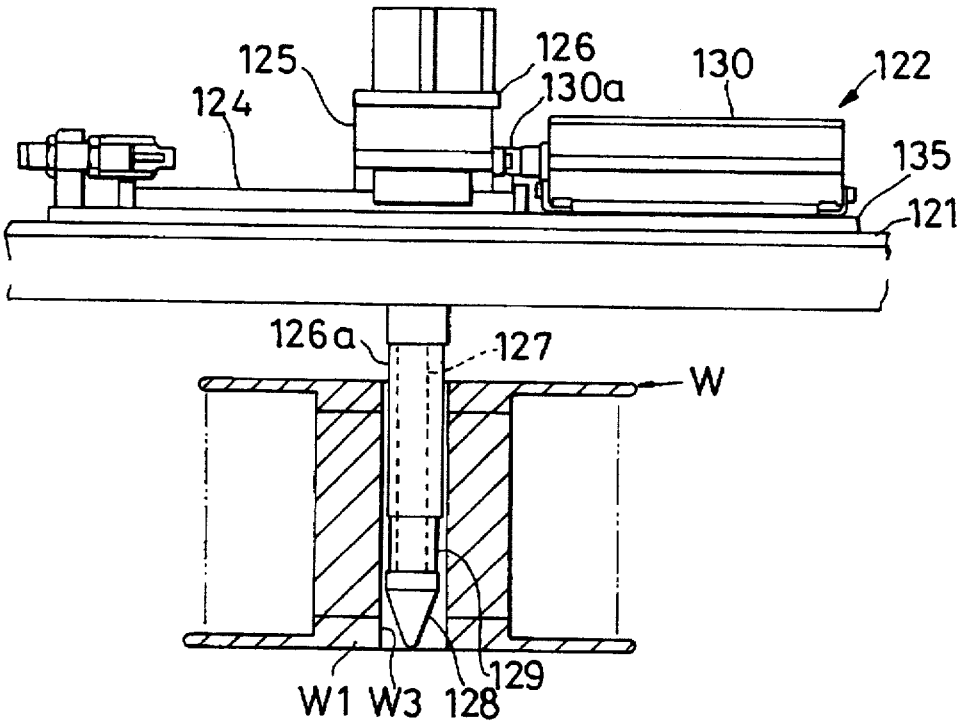
FIG. 18 is an enlarged side view of the holding means in FIG. 17.

Moreover, as shown in FIGS. 17 and 18, a cylinder 130 for adjusting the interval between spools W to an equal pitch for transfer to the next process by moving the moving member 125 is arranged on each base plate 135. The front end of a retractable rod 130*a* of the cylinder 130 is connected to the moving member 125.

As shown in FIG. 17, a detecting means 131 comprising a limit switch for determining the lower limit when the first holding means 122 (plate member 121) is lowered by the power cylinder 118 is provided on the first flat plate member 121. A detection rod (not shown) of the detecting means 131 protrudes downward beyond the plate member 121. When the front end (bottom) of the detection rod contacts a flange W2 of one spool W, the power cylinder 118 stops and downward movement of the first holding means 122 stops.

As shown in FIGS. 13, 15, and 16, the removing means 140 for removing the partition Wz has a second moving frame 141 which is set at the left of the taking-out means 110 and runs along the third guide rails 102. A holding frame 142 is suspended from the second moving frame 141 and second holding means 143 for sucking and holding the partition Wz is set to the holding frame 142.

The second holding means 143 has a lifting cylinder 144 set to the holding frame 142 with a retractable rod 144*a* facing downward and a second flat plate member 145 is horizontally secured to the front end (bottom) of the rod 144*a* of the cylinder 144. A plurality of third guide rods 146 are vertically set on the second plate member 145, each of the third rods 146 being inserted into a guide cylinder 142a set to the holding frame 142, and the top of each rod 146 extending above the holding frame 142.

A plurality of vacuum pads 147 for sucking and holding the partition Wz protrude downward under the second plate member 145.

Two second running cylinders 149 for running the second moving frame 141 along the third guide rails 102 are set to the second moving frame 141. Retractable rods 149a of these second running cylinders 149 are arranged along the third guide rails 102 and their front ends are connected to the first moving frame 111 of the taking-out means 110. Therefore, the removing means 140 is reciprocated between the upper portion of the conveyor systems 50 and 70 and a partition storage place Z provided at the left (right in the transfer direction C) of the conveyor systems 50 and 70 in FIGS. 13, 15 by the first running cylinder 115 of the taking-out means 110 and the second running cylinder 149.

Figure 19:
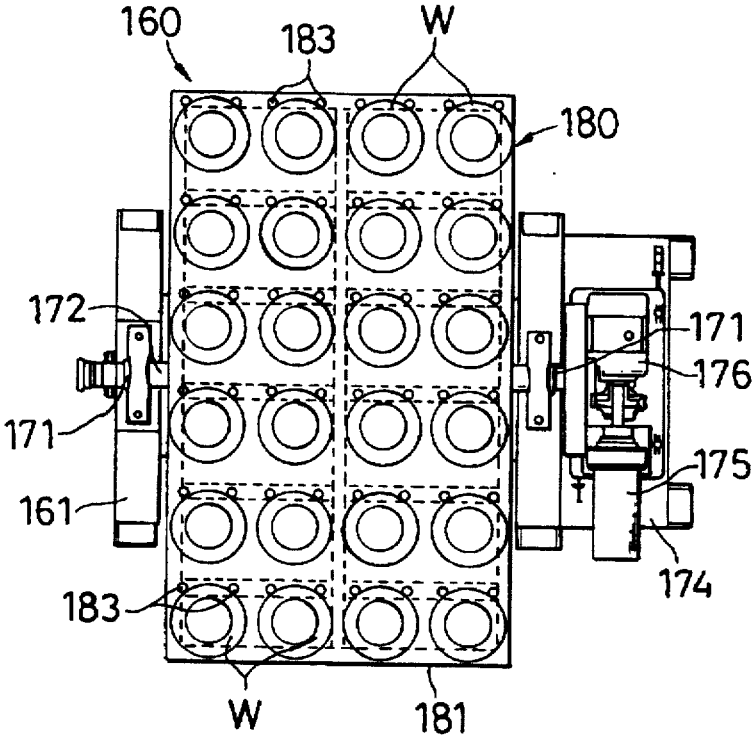
FIG. 19 is a top view showing a delivering means of the loading means.
Figure 20:
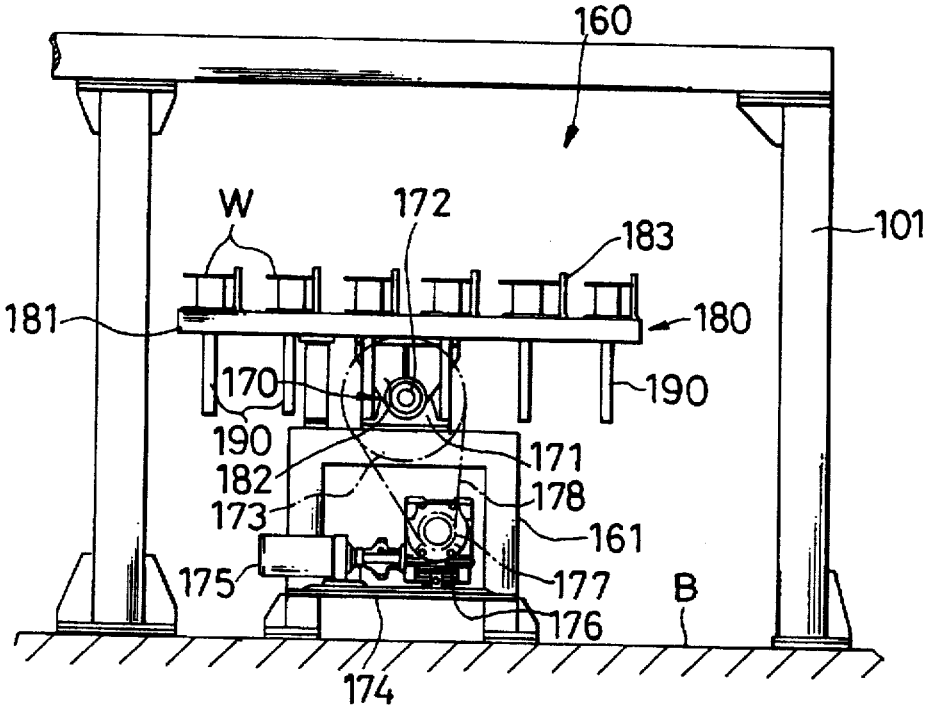
FIG. 20 is a side view of the delivering means in FIG. 19.
Figure 21:
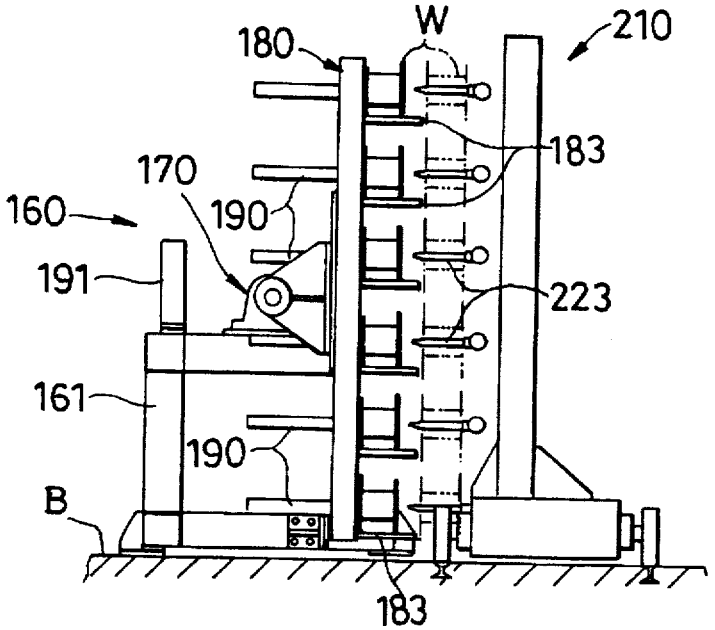
FIG. 21 is a side view showing the state in which a mounting plate of the delivering means in FIG. 20 rotates.

The delivering means 160 is set under the support frame 101 at the right (left in the transfer direction C) of the fourth and sixth conveyor systems 50 and 70 one each. As shown in FIGS. 19 to 21, each delivering means 160 has mounting means 180 for mounting the spools W taken out by the taking-out means 110 on a support frame 161 provided on the base B through a rotary mechanism 170.

The rotary mechanism 170 has a pair of bearing members 171 secured onto the support frame 161 at a predetermined interval along the running direction of the first moving frame 111 of the taking-out means 110 and a pivot 172 with a pulley 173 secured to one end of it is rotatably supported by these bearing members 171. A rotating motor 175 for rotating the pivot 172 is set to a support 174 set to the base B. The rotating motor 175 is connected to a transfer mechanism 176 for changing a rotational direction by 90°. An outputting pulley 177 is set to the transfer mechanism 176 and a belt 178 is passed around the pulley 177 and the pulley 173 secured to the pivot 172 so that the driving force of the rotating motor 175 is transferred to the pivot 172.

As shown in FIG. 20, the mounting means 180 has a flat mounting plate 181 whose bottom (back) is secured to and supported by a plurality of brackets 182 fixed to the pivot 172 and a pair of holding pins 183 for holding and positioning each mounted spool W when the mounting plate 181 changes from the horizontal orientation shown in FIG. 20 to the vertical orientation shown in FIG. 21. These pins 183 protrude from the mounting position of each spool W on the top (surface) of the mounting plate 181.

Moreover, an extruding cylinder 190 with a retractable extruding rod is mounted on the back of the mounting plate 181 as extruding means for extruding each spool W held by the holding pins 183 toward the moving means 200. The retractable extruding rod of the extruding cylinder 190 can rise above or retract below the surface of the mounting plate 181. A plurality of supporting members 191 are provided on the support frame 161 for supporting the mounting plate 181 by contacting the plate 181 when the plate 181 becomes horizontal.

Figure 22:
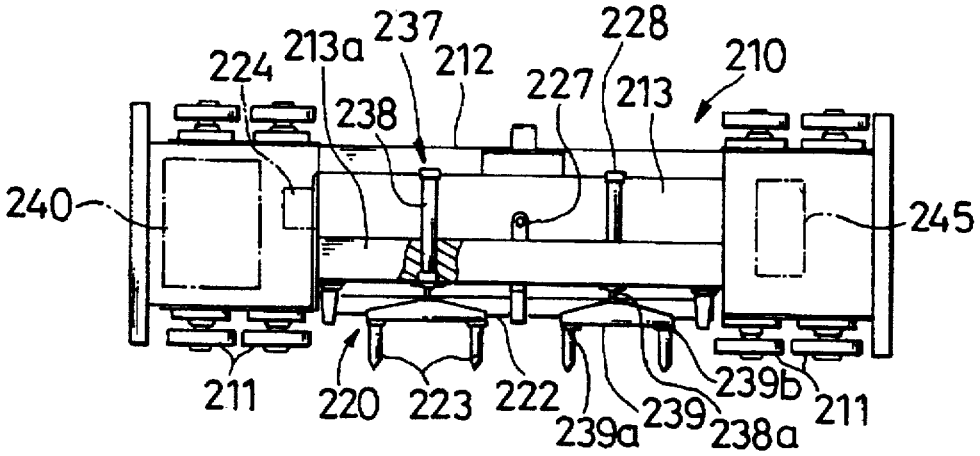
FIG. 22 is a schematic top view showing a first moving means of the moving means in the spool feeder of the present invention.
Figure 23:
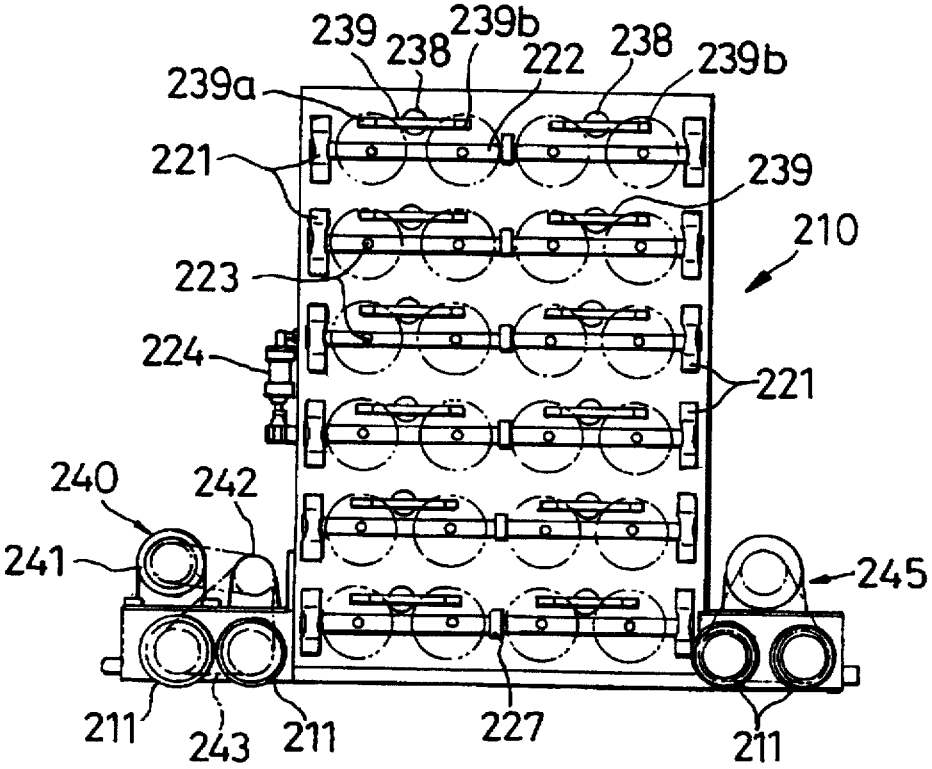
FIG. 23 is a front view of FIG. 22.
Figure 24:
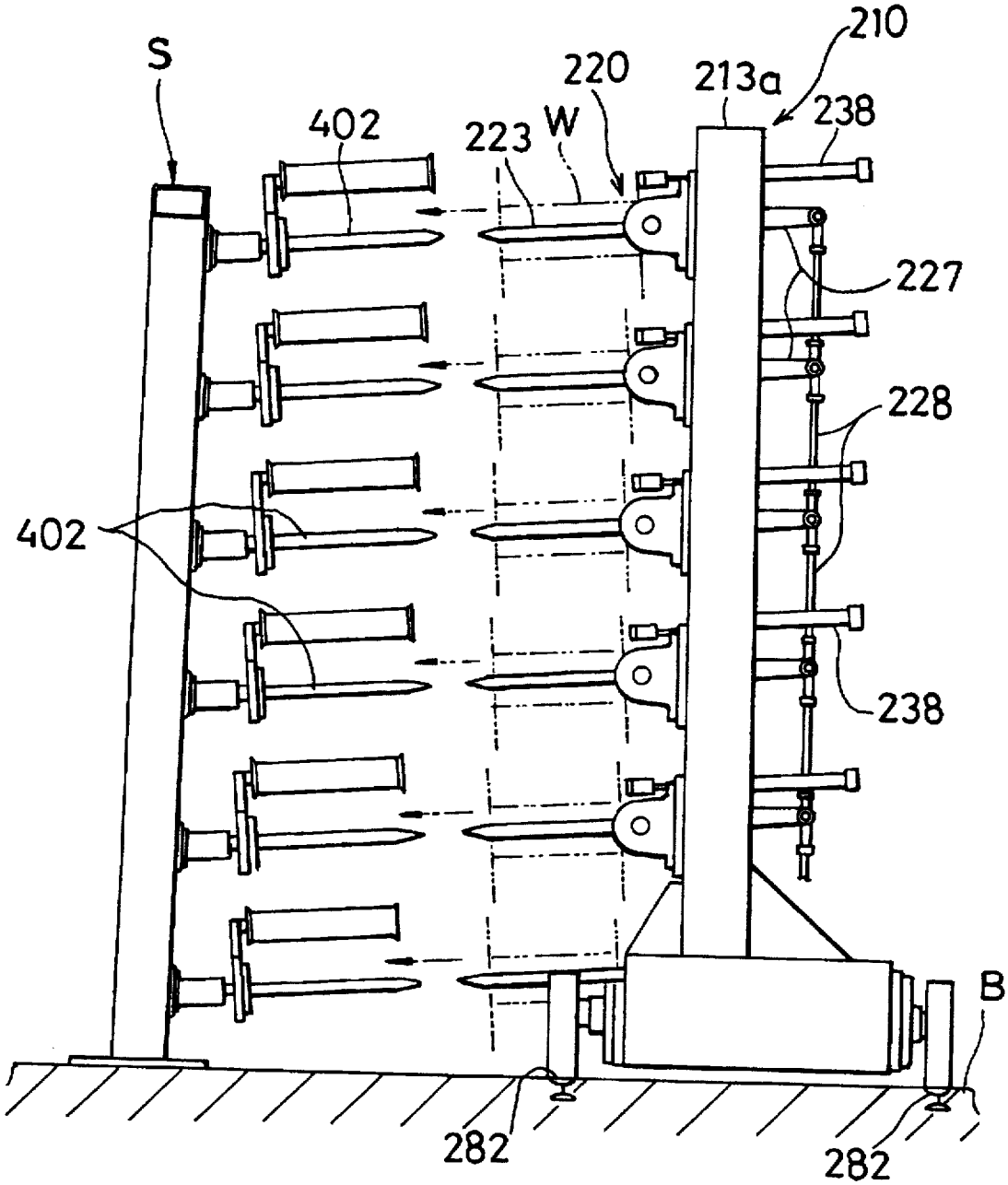
FIG. 24 is a side view showing the state in which spools are delivered from the holding means of the first moving means to a creel stand.
Figure 25:
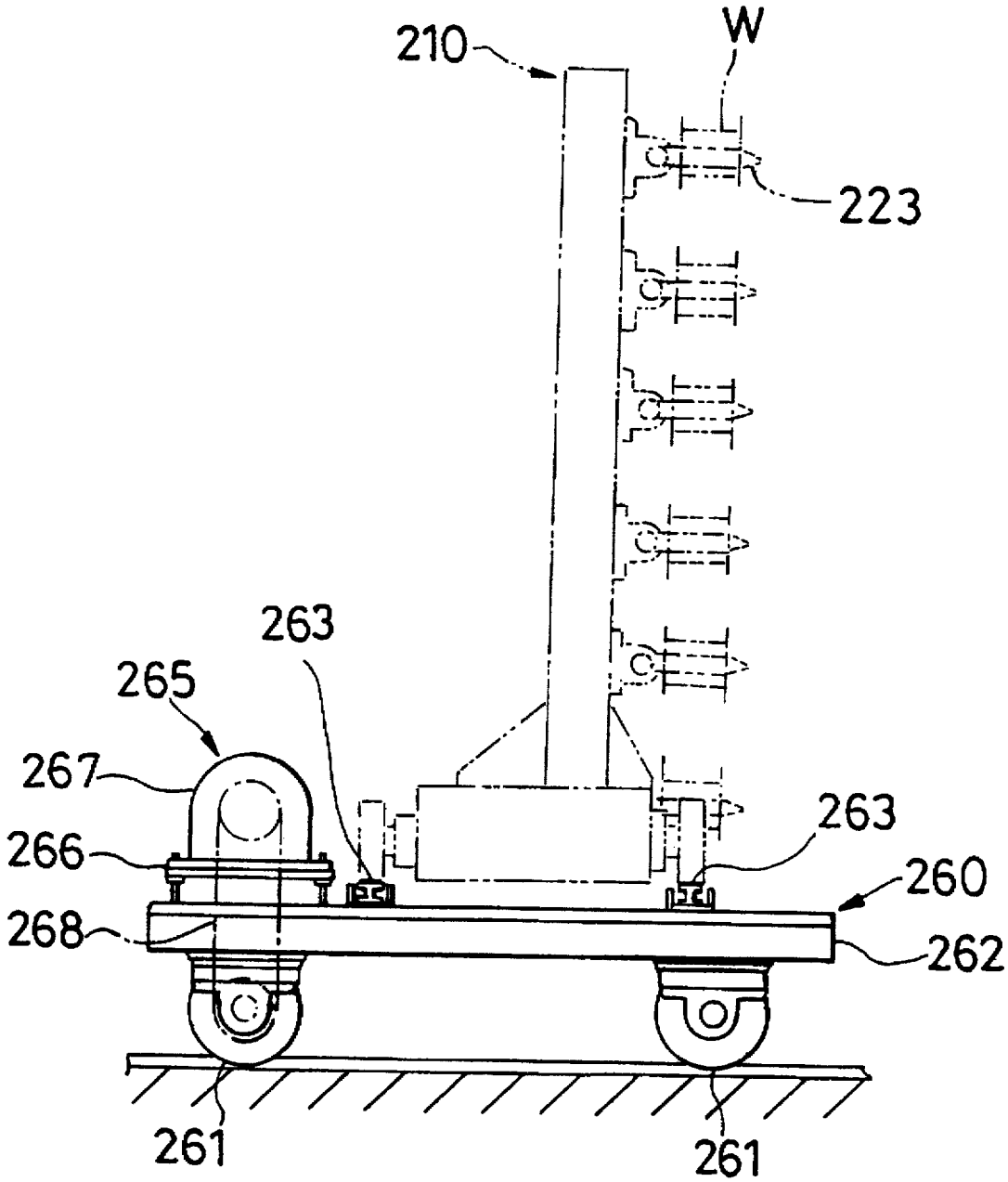
FIG. 25 is a side view showing a second moving means of the moving means in the spool feeder of the present invention.
Figure 26:
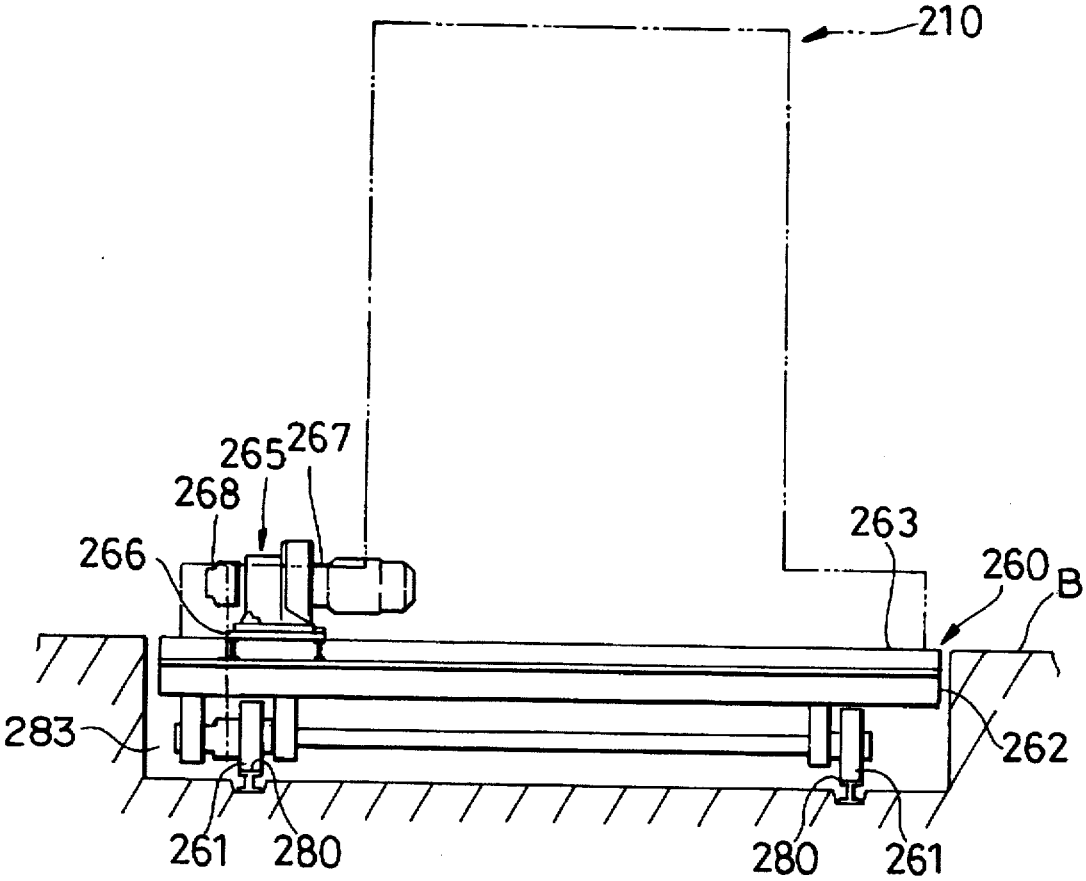
FIG. 26 is a front view of FIG. 25.

Two moving means 200 are provided correspondingly to the two delivering means 160 as shown in FIG. 1, each of which comprises first moving means 210 which moves holding the spools W as shown in FIGS. 22 to 24 and second moving means 260 which moves while mounting the first moving means 210 as shown in FIGS. 25 and 26.

The first moving means 210 comprises a running body 212 having rotatable supporting wheels 211 and a holding section 220 for holding each loaded spool W. The holding section 220 is set on the running body 212 on a vertically-set supporting member 213 with a L-shaped cross section. The holding section 220 has a plurality of holding shafts 222 (six holding shafts for this embodiment) horizontally and rotatably supported by bearing members 221 on the surface (side facing the delivering means 160) of a flat support 213a of the supporting member 213 arranged along the running direction of the first moving means 210 through the bearing member 221. Each of the shafts 222 is arranged vertically and in parallel. Holding pins 223 for holding each spool W are secured to each holding shaft 222 so as to protrude in a direction perpendicular to the holding shaft 222 and horizontally.

Figure 27:
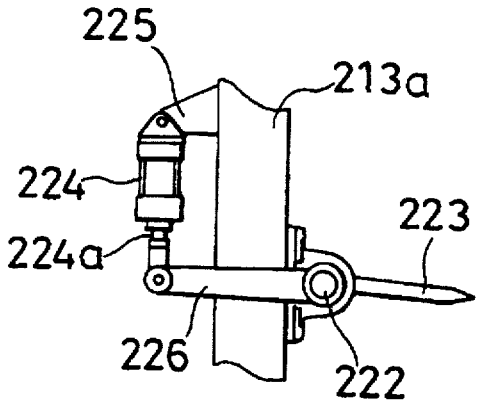
FIG. 27 is an illustration of an important portion showing angle adjusting means provided on the first moving means to adjust the angle of a holding pin for holding a spool.

An angle adjusting cylinder 224 for adjusting the angle of the holding pins 223 when delivering the spools W to a creel stand S is provided on one side of the support 213a. As shown in FIG. 27, the angle adjusting cylinder 224 has a retractable rod 224a extending downward and is provided on the support 213a through a bracket 225. The front end (bottom) of the rod 224a is connected to an arm 226 secured to one end of the third holding shaft 222 from the bottom.

A connecting arm 227 is protruded toward the back of the support 213a at the center of each holding shaft 222 and the end of each arm 227 is connected by a connection rod 228. Therefore, when the angle adjusting cylinder 224 operates, the third holding shaft 222 from the bottom rotates in the cylinder operating direction, and thereby other holding shafts 222 also rotate through the connecting arm 227 and the connection rod 228 and the angle of each of the holding pins 223 is adjusted.

Moreover, extruding means 237 for extruding the spools W held by the holding pins 223 to deliver them to the creel stand S is provided between every two holding pins 223 on the support 213a. Each extruding means 237 has an extruding cylinder 238 for extruding the spools W. Each extruding cylinder 238 is secured to the support 213a with its retractable rod 238a toward the surface of the support 213a. A pressing member 239 with contact portions 239a and 239b contacting flanges W2 of two horizontally adjacent spools W respectively at its both sides is provided on the front end of the rod 238a.

Figure 28:
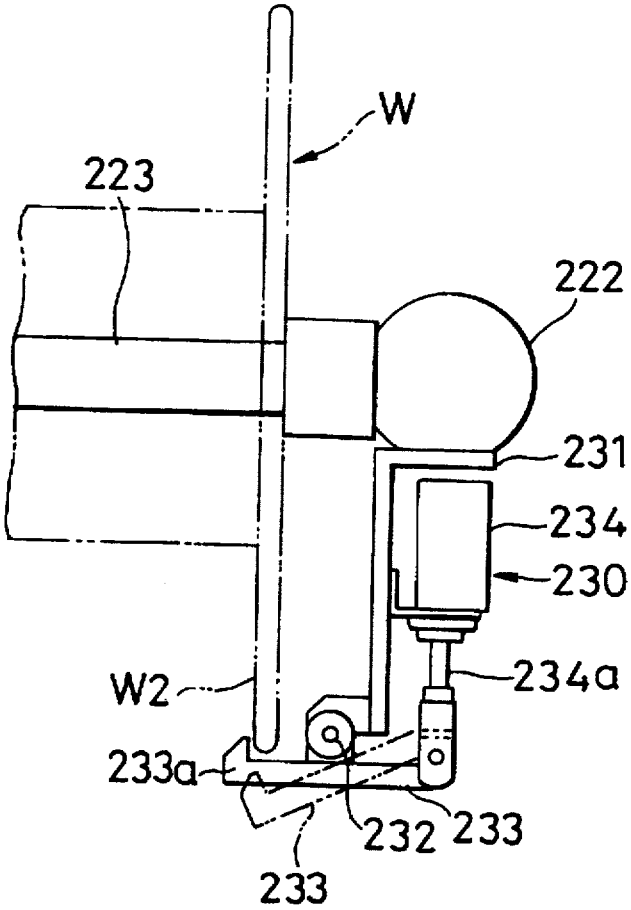
FIG. 28 is a side view showing a locking means for securing a spool to a holding pin.

Locking means 230 shown in FIG. 28 for locking each spool W loaded on the holding pin 223 is secured to each part of the holding shafts 222 where each holding pin 223 is fixed. The locking means 230 has a vertically-swingable securing pawl 233 at the bottom of a bracket 231 protruding downward from holding shaft 222 using a support pin 232 as a fulcrum. A pawl part 232a, which is protruded upward and can be engaged with the flange W2 of the spool W is formed at the front end of the securing pawl 233. The rear end of the securing pawl 233 is connected to the front end (bottom) off a downward-retractable rod 234a of a locking cylinder 234 set to the bracket 231. Therefore, when the rod 234a of the locking cylinder 234 extends, the securing paw 233 rotates clockwise about the support pin 232 and the pawl part 233a engages with the flange W2 to lock the spool W in place on the pin 223.

A driving means 240 for driving the wheels 211 is set on one end of the running body 212 in the running direction. The driving means 240 comprises a driving motor 241, a clutch mechanism 242, and a transfer mechanism 243 such as a pulley and belt mounted on the running body 212. The rotational driving force of the driving motor 241 is transferred to the wheels 211 through the clutch mechanism 242 and transfer mechanism 243 to move the running body 212. Disk braking means 245 for stopping the first moving means 210 is set to the other end of the running body 212 in the running direction.

As shown in FIGS. 25 and 26, the second moving means 260 has a running body 262 with rotatable supporting wheels 261. A pair of sixth guide rails 263 for mounting the first moving means 210 are laid on the flat surface of the running body 262 at a predetermined interval crossing the running body 262.

Driving means 265 for driving the wheels 261 is set on one side of the running body 262. The driving means 265 comprises a driving motor 267 provided on the running body 262 through a support plate 266 and a transfer mechanism 268 such as a pulley and belt to transfer the rotation of the driving motor 267 to the wheels 261 through it.

As shown in FIG. 1, the second moving means 260 runs on a pair of seventh guide rails 280 laid at the right of the loading means 100 (delivering means 160) in the same direction as the transfer direction C of the transferring means 10. The seventh guide rails 280 are laid in a recessed portion 283 formed on the base B and extend between a mounting position E for mounting the first moving means 210 loaded with the spools W and a sending position F for sending the first moving means 210 toward the creel stand S.

As shown in FIG. 1, the first two moving means 210 run on eighth and ninth guide rails 281 and 282 laid on two other parts of the base B in a direction perpendicular to the seventh guide rails 280. The eighth guide rails 281 extends from a spool receiving position G facing the delivering means 160 to the mounting position E mounted on the second moving means 260. A plurality of pairs of ninth guide rails 282 are laid from the sending position F to a position H for delivering the spools W to the creel stands S, correspondingly to the set number of creel stands S.

As shown in FIG. 1, the collecting means 300 comprises transferring and collecting means 310 for transferring the spool box Wx storing empty spools to the spool charging port X of the transferring means 10 and collecting the spools there, and a plurality of carrying means 350 for carrying empty spools between the transferring and collecting means 310 and the creel stands S.

Figure 29:
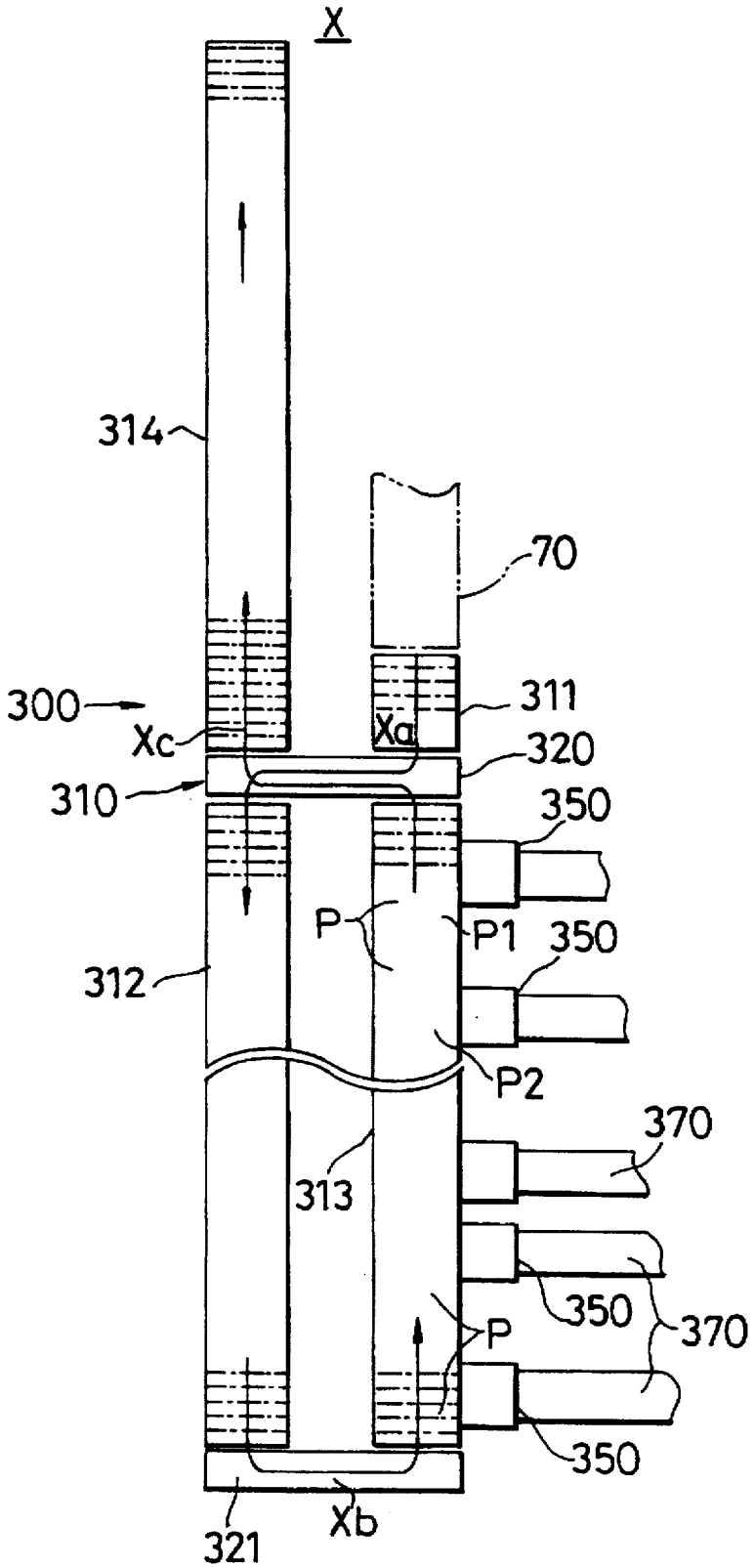
FIG. 29 is a top view showing the outline of a collecting system in the spool feeder of the present invention.

As schematically shown in FIG. 29, the transferring and collecting means 310 comprises four collecting conveyors 311, 312, 313, and 314 and two direction changing conveyors 320 and 321 for changing the transfer direction. The collecting conveyors 311, 312, 313, and 314 each comprise a chain driving conveyor in which a plurality of rollers are rotated by a chain similarly to the fourth and sixth conveyor systems 50 and 70. Each of the direction changing conveyors 320 and 321 has two chain conveyors whose transfer direction is different by 90° from each other. The conveyors 320 and 321 can rise up to and retract below the transferring surface.

The collecting conveyor 311 is used for connection with the transferring means 10 and connected to the transfer side of the sixth conveyor 70, which connects with the collecting conveyors 311 through the direction changing conveyor 320. This collecting conveyor 311 connects with the collecting conveyor 312 by way of the direction changing conveyor 320. The collecting conveyor 312 also connects with the collecting conveyor 314 extended up to the spool charging port X of the transferring means 10 by way of the direction changing conveyor 320. The empty spool box Wx on the sixth conveyor system 70 is transferred from the sixth conveyor system 70 to the collecting conveyor 311. The transfer direction of the box Wx is changed by the two chain conveyors of the direction changing conveyor 320 and the box Ws is transferred to the collecting conveyor 312 as shown by arrow Xa, further sent to the collecting conveyor 313 which transfers in the opposite direction to the collecting conveyor 312 through the direction changing conveyor 321 as shown by the arrow Xb, then loaded on the collecting conveyor 314 through the direction changing conveyor 320 as shown by the arrow Xc, and finally transferred up to the charging port X of the transferring means 10. In FIG. 29, symbol P represents transfer positions for transferring the spool boxes Wx from the carrying means 350.

Figure 30:
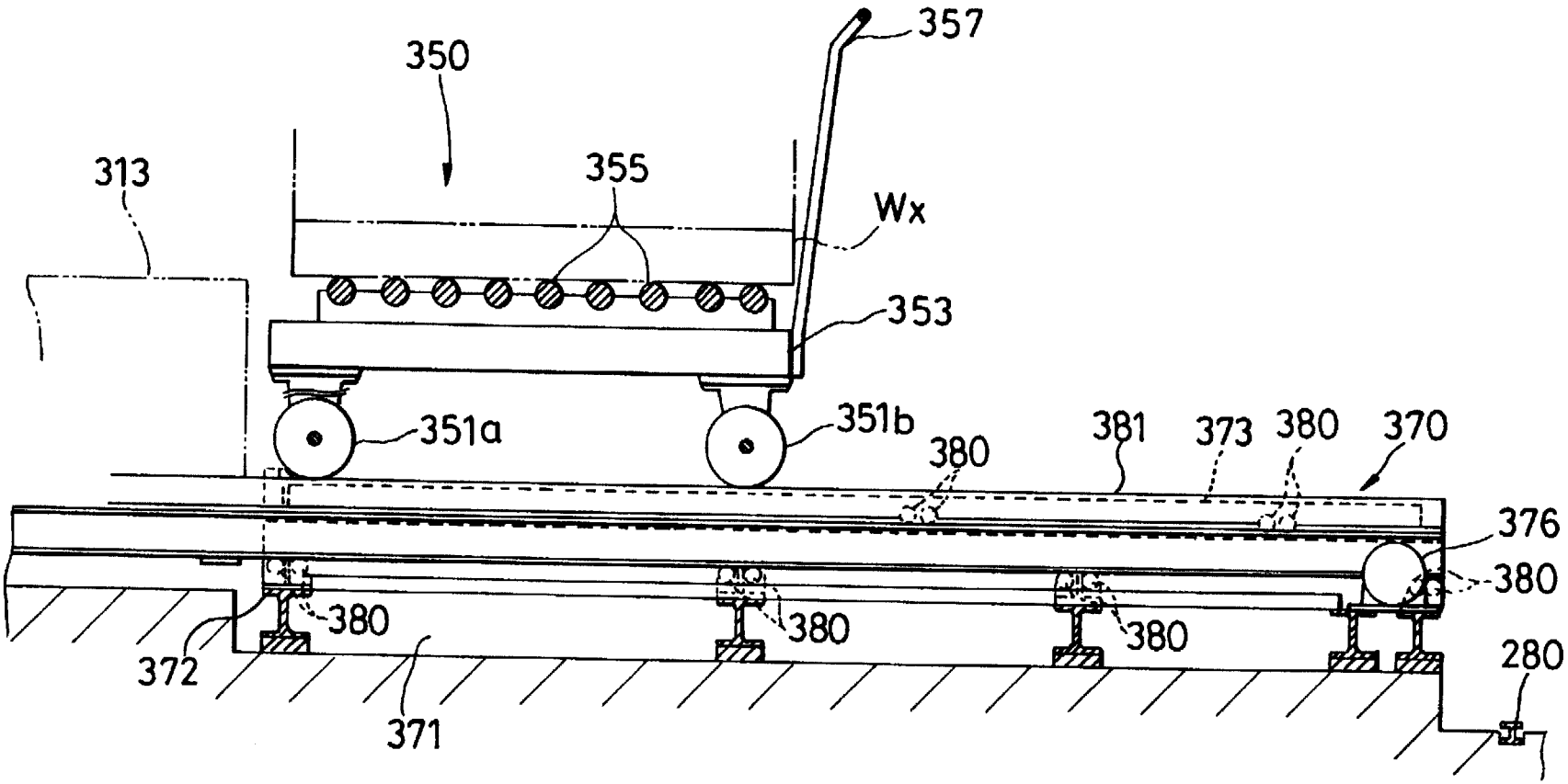
FIG. 30 is a sectional view taken along the line XXX—XXX of FIG. 31.
Figure 31:
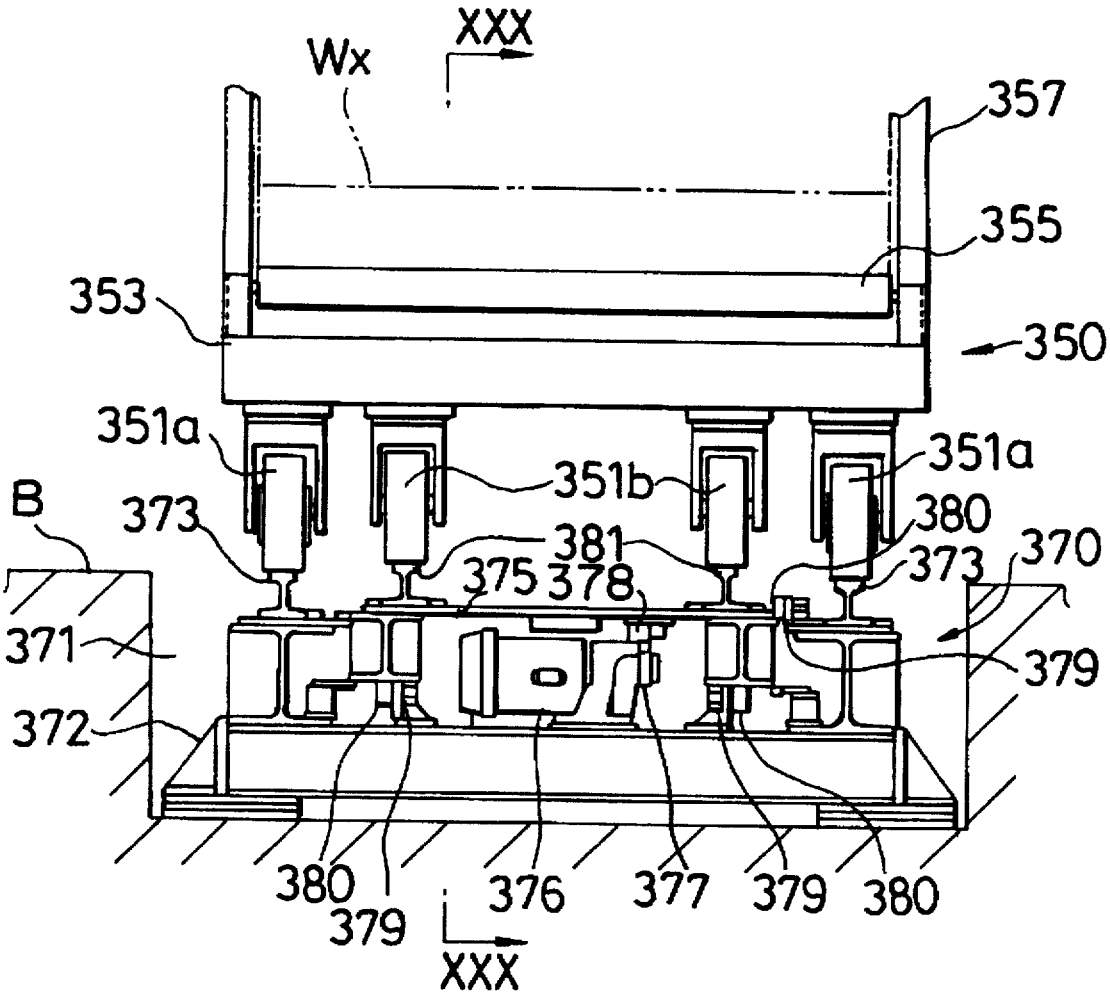
FIG. 31 is a side view of carrying means and a guide rail system of the collecting system in the spool feeder of the present invention.

As shown in FIGS. 30 and 31, each carrying means 350 comprises a carrying body 353 having four rotatable supporting wheels 351*a* and wheels 351*b* at the front and the rear, respectively. A plurality of freely rotating guide rollers 355 are arranged on the body 353 along the longitudinal direction. The transfer surface (top) of these guide rollers 355 is set at the same height as that of the collecting conveyor M. A manually operated pushing frame 357 for an operator to push the carrying means 350 protrudes upward from the rear end of the carrying body 353.

A guile rail device 370 on which each carrying means 350 runs is set between the collecting conveyor 313 and the guide rails 280 on which the second moving means 260 runs respectively. Each guide rail device 370 has a pair of running rails 373, on which both wheels 351*a* on the outer sides of each carrying means 350 run, on a support frame 372 set to a recessed portion 371 formed on the base B. The running rails 373 arranged so that its running surface on which the carrying means 350 runs has the same height as the eighth and ninth guide rails 281 and 282. The rails 373 extend so that they are aligned with the ninth guide rail 282 extended up to the delivery position H in front of the creel stand S from the sending position F in the transfer direction.

A moving frame 375 capable of reciprocating along the extending direction of the running rails 373 is arranged between the pair of running rails 373. A rack 378 engaged with a driving gear 377 of a driving motor 376 set to a support frame 372 is set to the bottom of the moving frame 375 which can be moved on guide rollers 380 rotatably supported through brackets 379 set on the support frame 372. The guide rollers 380 are arranged on a plurality of places at both sides of the moving direction so that the moving frame 375 moves on them by the driving motor 376 in the extending direction of the running rails 373.

A pair of tenth guide rails 381 are laid on the moving frame 375 in parallel with the running rails 373 so that both inner wheels 351*b* of each carrying means 350 run on the tenth guide rails 381.

Figure 33:
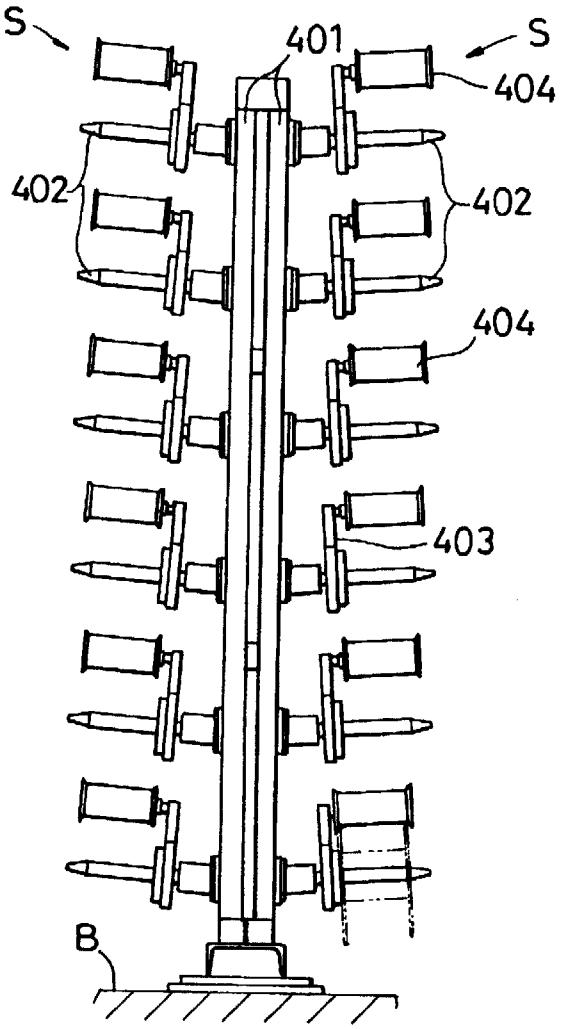
FIG. 33 is a front view of FIG. 32.
Figure 32:
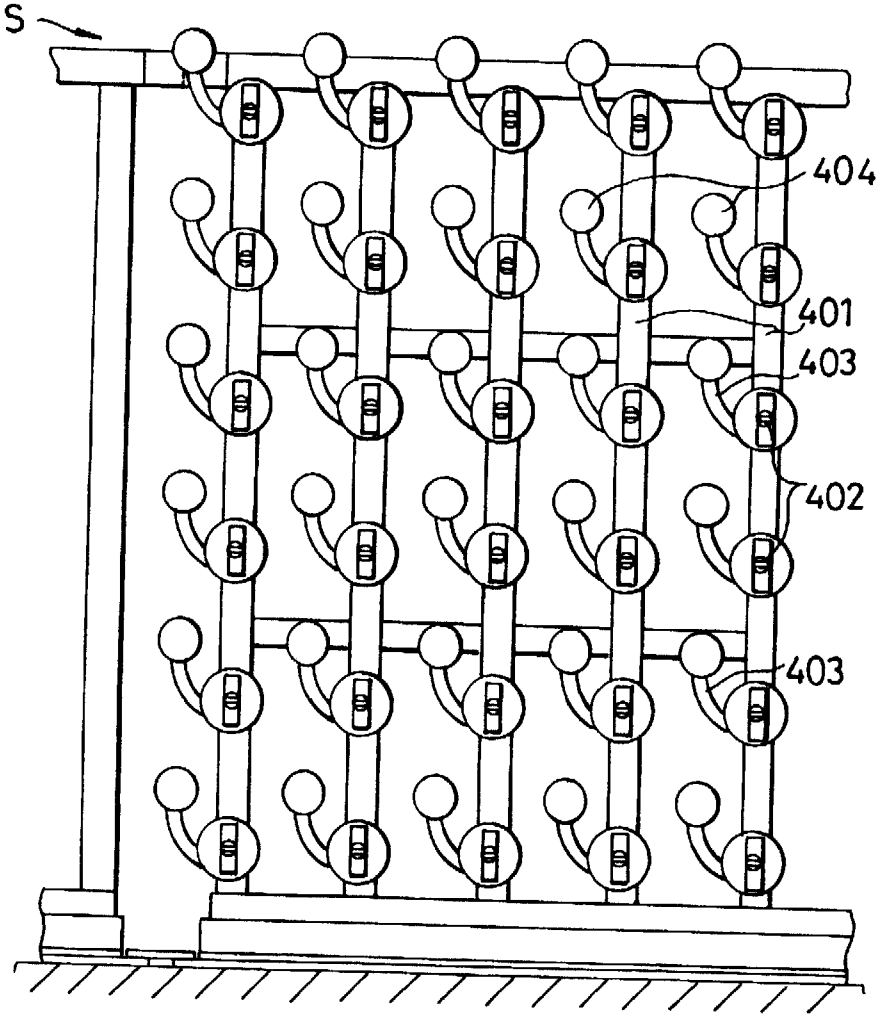
FIG. 32 is a side view of an important portion showing an example of a creel stand used for the present invention.
Figure 34:
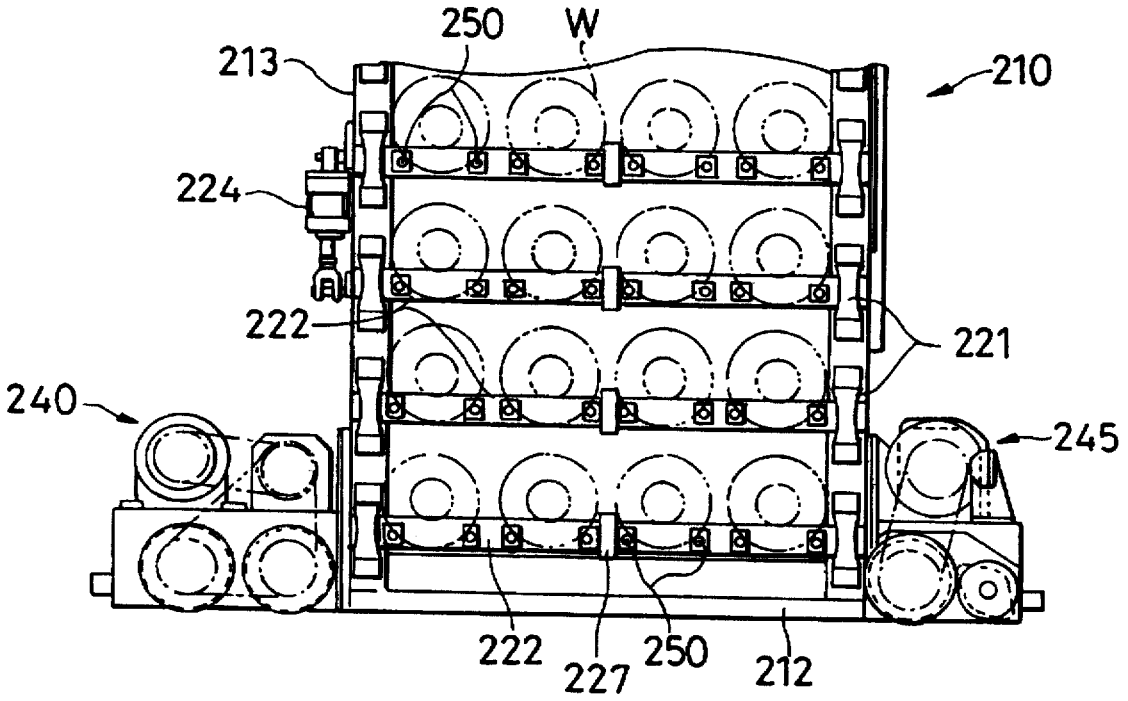
FIG. 34 is a partial front view of the first moving means provided with another spool holding means.

FIGS. 32 and 33 show a pair of creel stands S used for the present invention. Each creel stand S has a plurality of support poles 401 stood along the extending direction of ninth guide rails 282 vertically on the base B. A plurality of creel shafts 402 for receiving spools W are laterally arranged at a same interval of the holding pins 223 of the first moving means 210 at a side of each support pole 401 facing the first moving means 210. Each creel shaft 402 is set so that it is slightly inclined upward at a predetermined angle and the front end of it is tapered at an acute angle. A guide roller 404 for unwinding a cord from the spool W is set above each creel shaft 402 by way of a bracket 403 fixed on a base end of the creel shaft 402.

A method for feeding spools W having steel cord wound on them to creel stands S by using the device of the present invention having the above constitution is described below.

First, the spool box Wx on the mount L in which a layer of spools each with its flanges W2 at its top and bottom respectively piled having partitions Wz therebetween in a plurality of layers is fed to the first conveyor system 20 of the transferring means 10 set at the charging port X by a fork lift truck or the like. The charged-in spool box Wx is transferred on the first free roller conveyor 22 by the first chain conveyor 23 and sent to the second conveyor system 30.

When the spool box Wx is transferred up to the central position of the second free roller conveyor 32 of the second conveyor system 30, transfer of the second conveyor system 30 is stopped. Then, as shown in FIGS. 7 and 8, the lifting member 81*b* is lifted by the lifting operation of the lifting cylinders 81*a* of the lifting means 81, both mounting sections 81*e* on the turntable 81 d rise above the transfer surface of the second chain conveyor 33 and second free roller conveyor 32. The mount L on which the spool box Wx is mounted is lifted up and mounted on the mounting sections 81*e*.

Then, the pressing means 82 operates and the front end of each cylinder rod presses both sides of the mount L. When the mount L (spool box Wx) gets out of position to the transfer direction C (see the imaginary line in FIG. 6), the spool box Wx is corrected through the rotation of the turntable 81*d* so that it becomes in a good position with both sides parallel with the transfer direction C.

When correction by the pressing means 82 is completed, the lifting member 81 b is lowered by the lowering operation of the lifting cylinders 81*a* of the lifting means 81 and the mount L is placed on the transfer surface of the second chain conveyor 33 and second free roller conveyor 32. After the tilting of the mount L is corrected and returned onto the conveyor transfer surface, the spool box Wx is transferred on the second free roller conveyor 32 by the second chain conveyor 33 and sent to the third conveyor system 40.

When the spool box Wx is transferred up to the central position of the third free roller conveyor 42 of the third conveyor system 40, the operation of the third conveyor system 40 is stopped. Then, the cylinder 95*a* of the positioning means 95 operates and its rod 95*c* extends to press the mount L. At the same time, the locked state of the locking cylinder 92*a* is released and rod 92 can be extended. Pressing the lateral side of the mount, moves the spool box Wx together with the carriage 91 in the cross direction of the transfer direction until the mount L contacts the rollers 95*f* of the positioning roller means 95.

At the width position where the mount L contacts the positioning roller means 95, the locking cylinder 92*a* is locked and the carriage 91 is locked by the extended rod 92*b* so that it is not moved, and the width positioning step for the spool box Wx is completed. Then, the spool box Wx is transferred on the third free roller conveyor 42 by the third chain conveyor 43 and sent to the fourth conveyor system 50.

When the spool box Wx is transferred onto the fourth conveyor system 50, the locked state of the locking cylinder 92*a* is released and operates, and the rod 92*b* shortens to return the cardage 91 to the original position where the third free roller conveyor 42 on the carriage 91 is aligned with those of the first and second conveyor systems 20 and 30. Then, the locking cylinder 92*a* is locked again.

In the present invention, as shown in FIGS. 4 and 5, whenever the spool box Wx charged in the latter half section of transfer of the first conveyor system 20 is transferred, the next spool Wx storing spools W is fed to the first conveyor system 20 one after another.

Therefore, the first or (odd-numbered) spool box Wx transferred to the fourth conveyor system 50 after completing the width positioning step is sent to the sixth conveyor system 70 through the fifth conveyor system 50. When the spool box Wx reaches the spool W takeout position Y, transfer of the box Wx is stopped. During the above period, the second or (even-numbered) spool box Wx is transferred up to the spool W takeout position Y on the fourth conveyor system 50.

When the spool box Wx is transferred to each takeout position Y and the fourth and sixth conveyor systems 50 and 70 stop, the cylinder 501 of the lifting means 500 operates to lift the support plate 503 through the linkage 502 and the spool box Wx on the roller conveyor is lifted up to a predetermined takeout position. After the box Wx is lifted up to the takeout position, the position of the box Wx is confirmed by a sensor (not-illustrated). When the position of the box deviates from the ideal position, the positioning means 510 operates. That is, the first and second cylinders 514 and 515 operate as required to move the roller conveyor of the fourth and sixth conveyor systems 50 and 70 in the transfer direction C or in a direction perpendicular to the direction C to adjust slightly the position of the spool box Wx in the horizontal direction to a predetermined takeout position.

Then, as shown in FIGS. 13 to 15, each standing-by taking-out means 110 operates. The first flat plate member 121 of the holding section 120 is lowered by the power cylinder 118 of the taking-out means 110 to lower the holding means 122 until each detecting means 131 contacts the flange W2 of the spool W while inserting the holding rod 127 provided with the press-contact member 129 into each spool bore W3.

After the lowering operation, each cylindrical rod 126*a* is extended by the cylinder 126 to press the press-contact member 129, which is expanded in the radius direction and presses the inner wall of the bore W3 of the spool W.

By operating the power cylinder 118 to raise the holding section 120 in the above condition, a spool row mounted on the highest stage is held by the holding rods 127 and rises together with the holding section 120. When the holding section 120 rises up to the initial stand-by position, each rod 130*a* is extended by the adjusting cylinder 130 to move the moving member 125. The interval of the rods 130*a* is adjusted to deliver the spools to the delivering means 160. After that, the rods 115*a* are extended by the running cylinder 115 to move the moving frame 111 along the guide rail 102 extended in a direction perpendicular to the transfer direction C and transfer the taking-out means 110 holding the spool W above the delivering means 160. At the same time, the removing means 140 above the partition storage place Z also moves along with the taking-out means 110 and reaches a position next to the taking-out means 110, because the removing means 140 and the taking-out means 110 are connected each other by the running cylinder 149.

Then, the running cylinder 149 operates and the removing means 140 moves in the direction of separating from the taking-out means 110 and separates to reach a position above the spool box Wx.

Then, the rod 118*a* is extended a predetermined length by the power cylinder 118 of the taking-out means 110 and at the same time the air cylinders 190 fixed to the mounting plate 181 are driven so that their cylinder rods extended upward to receive the spools W. Each cylinder 126 operates to shorten the cylindrical rod 126*a* so as to release the press-contact state of the press-contact member 129. Then, as shown in FIG. 20, each spool W is mounted on the mounting plate 181 of the mounting means 180 next to each pair of corresponding holding pins 183. The spools W are mounted on the half area of the mounting plate 181. During the above period, the removing means 140 lowers the holding means 143 for sucking and holding the partition Wz by movement of the lifting cylinder 144 and suck and hold the uppermost partition Wz in the spool box Wx by the vacuum pad 147.

When the spools W are mounted on the mounting plate 181, the rod 118*a* is shortened by the power cylinder 118 of the taking-out means 110 to raise the holding section 120. The lifting cylinder 144 removing means 140 is operated to raise the holding means 143 holding the partition Wz.

After the holding means 143 is raised the adjusting cylinders 130 of the taking-out means 110 are operated to return the interval of the holding rod 127 of the holding means 122 to the original state. The running cylinders 149 of the removing means 140 are operated, so that the rods 149*a* are shortened and the removing means 140 is moved to a position next to the taking-out means 110.

At the same time of movement of the running cylinders 149, the running cylinders 115 are operated to shorten the rods 115*a* so that the taking-out means 110 is moved above the spool box Wx on the transferring means 10 and the removing means 140 is moved above the partition storage place Z.

Then, the lifting cylinder 144 of the removing means 140 is operated so that the rod 144*a* is extended up to the maximum stroke. Thereafter the vacuum of the vacuum pads 144 is released and the held partition Wz is dropped onto the partition storage place Z. During the above period, in the taking-out means 110, the next spool takeout step is executed. After that, the rod 114*a* of each taking-out means 110 is extended by the driving cylinder 114, the running and holding section 113 is moved in the inner direction in FIG. 13, and the next uppermost spool row is mounted on the remaining half area of the mounting plate 181.

When spools W are mounted on the entire area of each mounting plate 181, the rotating motor 175 of the delivering means 160 is operated to rotate the mounting plate 181 through 90° about the rotary shaft 172 and toward the guide rails 281 respectively. The spools W mounted on the mounting plate 181 with both flanges W2 located at the top and bottom of the spool W are then held by each pair of holding pins 183 provided on the mounting plate 181 with the flanges W2 located horizontally in the right and left positions of the spool W.

When rotation of the delivering means 160 ends, the first moving means 210 mounted on the second moving means 260 standing by at each mounting position E is operated. The driving motor 241 of the driving means 240 is operated, the running body 212 self-advances on the guide mils 281, and the first moving means 210 moves up to the spool receiving position G facing the mounting plate 181 which is rotated by 90°.

As shown in FIG. 21, when both of the first moving means 210 reach the spool receiving positions G facing each mounting plate 181, the spools VV are loaded on the first moving means 210 from the delivering means 160. That is, the extruding cylinders 190 of the delivering means 160 are operated and cylinder rods press the flanges W2 of the spools W to extrude the spools W toward the first moving means 210. Each bore W3 of the spools W is fitted over the horizontally-protruded holding pin 223 of the holding section 22C of the first moving means 210 respectively and the spools W are held by the holding pins 223 of the first moving means 210 as shown by the imaginary line in FIG. 21.

When loading of the spools W on the first moving means 210 is completed, each rod 234*a* is extended by the locking cylinder 234 of the locking means 230 and the securing pawl part 233 rotates clockwise about the support pin 233 to make the pawl 233*a* engage with the flange W2 of the spool W and lock the spool W on the holding pins 223.

Then, each driving motor 241 is operated to move the first moving means 210 on the guide rails 281 up to the second moving means 260 standing by at the mounting position E. When the first moving means 210 are mounted on the second moving means 260 respectively, each driving motor 267 of the second moving means 260 is operated to move each second moving means 260 on the guide rails 280 up to the sending positions F1 and F2 for sending the first moving means 210 toward the creel stands S.

When the second moving means 260 reach the sending positions, each first moving means 210 moves from the guide rails 263 of the second moving means 260 to the guide rails on the base B and further moves on the guide rails 282 up to each delivery position H facing each creel stand S.

As shown in FIG. 24, when the holding section 220 of each first moving means 210 stops in front of the creel shafts 402 of each creel stand S, each rod 234*a* is shortened by the locking cylinder 234 of the locking means 230, the securing pawl 232 rotates counterclockwise about the support pin 233, the pawl part 233*a* engaged with the flange W2 of the spool W disengages, and the locked state of each spool W is released.

Then, the rod 224*a* of the angle adjusting cylinder 224 of each first moving means 210 is shortened, the third holding shaft 22 from the bottom connected to the rod 224*a* through the arm 226 is slightly rotated, and each holding pin 223, with its front end lower than its base end, is approximately aligned with each creel shaft 402 whose front end is slightly directed upward. The third holding shaft 222 rotates and thereby the remaining holding shafts 222 connected through the connecting arms 227 and the connection rod 228 also are rotated. Thus, as shown in FIG. 24, every holding pin 223 is approximately aligned with each creel shaft 402.

Then, the extruding cylinders 238 are operated and its rods 238*a* are extended. The contact portions 239*a* and 239*b* of each pressing member 239 press the flanges W2 of the spools W to extrude the spools W toward each of the creel stands S. The bore W3 of each spool W is fitted over each creel shaft 402 and, as shown in FIG. 33, the spools W are delivered to the creel shafts 402 and fed to the creel stands S.

After each delivering means 160 delivers the spools W mounted on the mounting plate 181 to each first moving means, the above-mentioned taking-out means 110 is operated to repeat the step of mounting the remaining spools W stored in the spool box Wx on the mounting plate 181 of the delivering means 160 again while removing the partitions Wz by the removing means 140.

Each first moving means 210 that has delivered the spools W to each creel stand S moves up to each mounting position E, receives spools W from the delivering means 160 again, and repeats the step of feeding the spools W to another creel stand S.

Therefore, it is possible to feed spools W having steel cord wound on them automatically without any human intervention from the spool box to creel stands S away from the charging position.

The following is the description of the step of collecting the empty spools from the creel stand S.

After all spools W are taken out of the spool box Wx by the taking-out means 10, empty spool boxes Wx on the conveyor systems 50 and 70 of the transferring means 10 are transferred to the collecting means 300. That is, the spool box Wx on the sixth conveyor system 70 is transferred to the collecting conveyor 311, the direction changing conveyor 320, collecting conveyor 312, direction changing conveyor system 321, and collecting conveyor 313. When the spool box Wx reaches a transfer position P1, it is loaded by the operator on the guide rollers 355 of the carrying means 350 with its transfer surface kept at almost the same height as that of the collecting conveyor 313.

The spool box Wx on the fourth conveyor system 50 is transferred through the fifth and sixth conveyor systems 60 and 70 to the collecting conveyor 311, direction changing conveyor 320, collecting conveyor 312, direction changing conveyor 321, and collecting conveyor system 313 similarly to the spool box Wx on the sixth conveyor systems. When the spool box Wx reaches a transfer position P2, it is loaded on the guide rollers 355 of another carrying means 350 by the operator.

When the cord wound on each spool W in the creel stand S is used up and thereby the spools W become empty, the operator transfers the carrying means 350 up to the creel stand S. That is, the operator transfers the carrying means 350 on the running rails 373 up to the guide rails 280 located at the sending position F where the second moving means 260 runs. Then, the operator confirms that the second moving means is not present at the sending position F and operates the driving motor 376 to move the moving frame 375 over the recessed portion 281 where the guide rails 280 are laid, by way of the driving gear 377 and the rack 378 engaged with it. As the moving frame 375 is moved, the guide rails 381 are laid over the recessed portion 283 so as to cross the recessed portion 283. The carrying means 350 is transferred through the guide rails 381 crossing above the guide rails 280 where the second moving means 260 run. And the carrying means 350 is transferred on the guide rails 282 up to the creel stand S.

Then empty spools are collected from the creel stand S into the spool box Wx on the carrying means 350. After the spool box Wx is full of empty spools, then the box Wx is loaded on the collecting conveyor 313 and transferred from the collecting conveyor 313 to the direction changing conveyor 320 and collecting conveyor 314 and empty spools are collected on the charging port X. Therefore, spool collection can be performed easily and efficiently. Other carrying means 350 in other transfer positions P corresponding to other creel stands S are operated in the same manner as well.

FIGS. 34 to 37 show an alternative holding means set on the first moving means 210 of the present invention, which is constituted so as to hold each spool W with pairs of holding bars 250 for mounting the spool W instead of using the holding pin 223.

Figure 35:
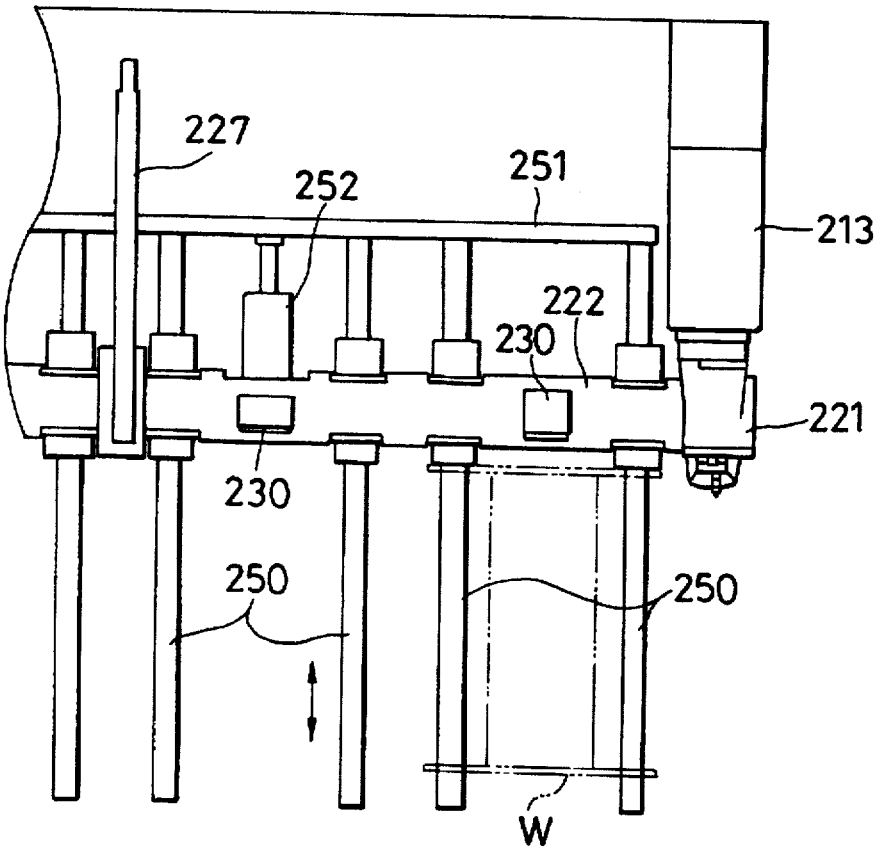
FIG. 35 is a top view of an important portion of FIG. 34.

As shown in FIG. 35, each pair of holding bars 250 for mounting the spool W horizontally protrude from each holding shaft 222 at a predetermined interval and are slidably set along the axial direction of the holding bar 250. The rear end of each holding bar 250 set to the same holding shaft 222 is connected by the connection bar 251. A driving cylinder 252 for moving the holding bar 250 forward and backward is connected between each connection bar 251 and each holding shaft 222.

Figure 36:
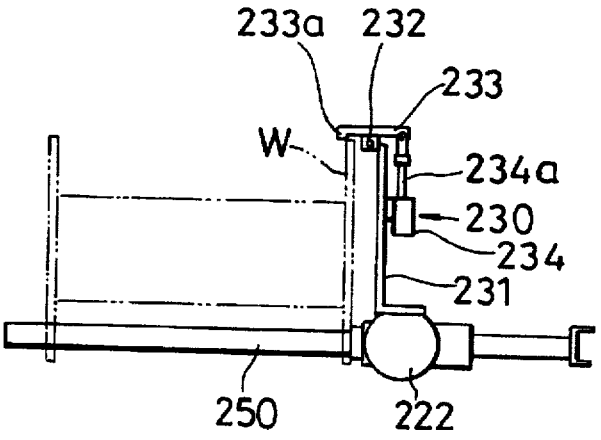
FIG. 36 is a side view showing spool locking means used for the first moving means in FIG. 34.
Figure 37:
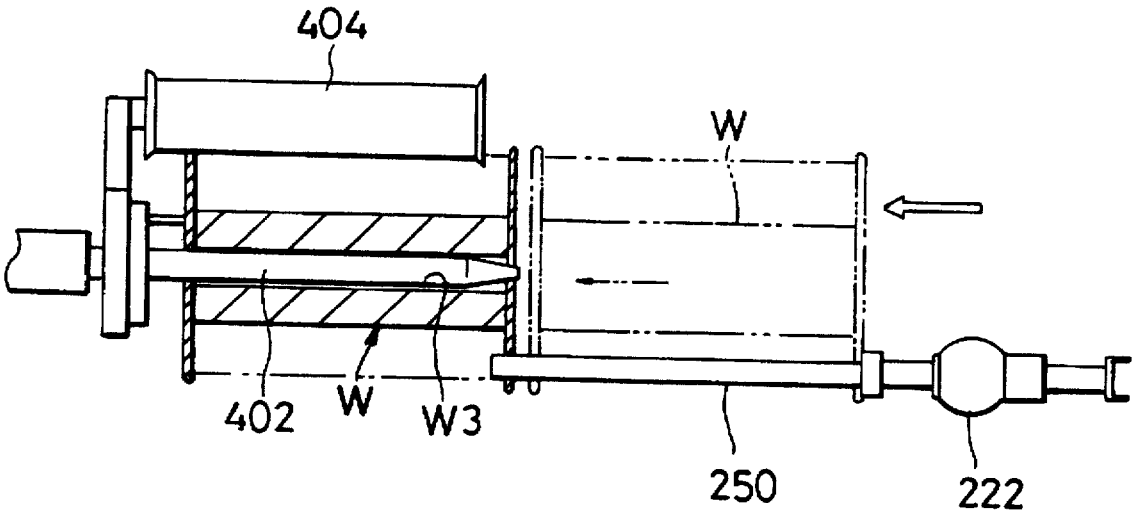
FIG. 37 is an illustration showing the state in which spools are delivered to a creel stand when using a holding bar in FIG. 34.

As shown in FIG. 36, the locking means 230 is set above the holding shaft 222. The pawl part 233*a* at the front end of the securing pawl 233 engages with the upper portion of the flange W2 of the horizontally held spool W. Moreover, the support member 213 is formed like a frame.

In this embodiment, each pair of holding bars 250 is extruded forward by the driving cylinder 252 when the spools W are received from the delivering means 160 and the spools W are delivered to the creel stand S. When the first moving means 210 moves, holding bars 250 stay backward.

As described above, by mounting each spool W on each pair of holding bars 250 to hold it, it is possible to insert each creel shaft 402 with a diameter smaller than that of the bore W3 of the spool W into the bore W3. Therefore, delivering does not require an accurate alignment as in the case of using the holding pin 223 and the creel shaft 402. Thus, it is possible to perform the alignment of holding means with the creel shaft 402 more easily.

Figure 38:
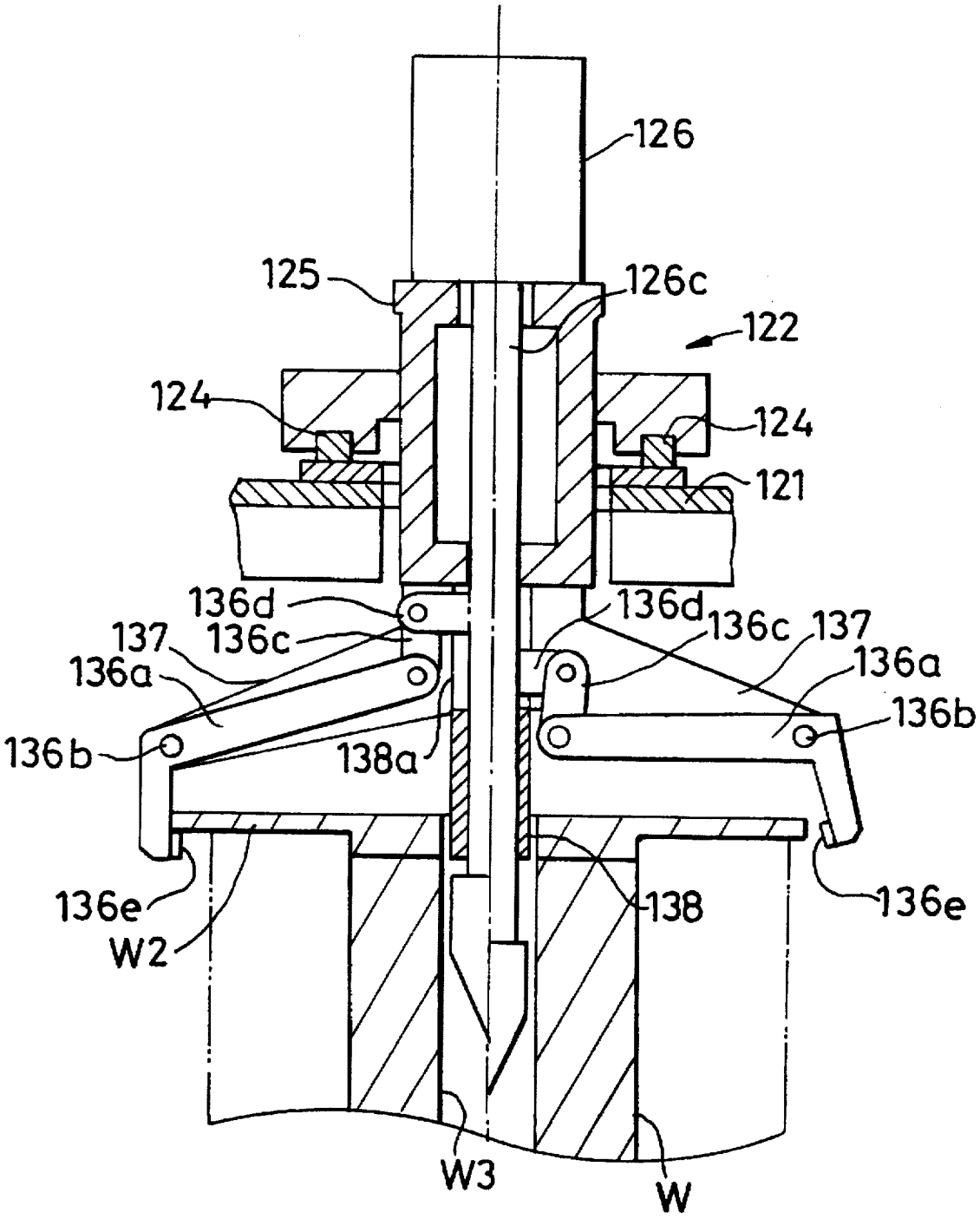
FIG. 38 is a sectional view of another holding means used for a taking-out means, in which the left side shows a state of holding the spool and the right side shows a state of releasing the spool from holding.

FIG. 8 shows another holding means used for the holding section 120 of the taking-out means 110. This holding means 122 has a pair of hook members 136*a* to hold a spool W instead of the press-contact member 129 described above. A pair of brackets 137 are fixed under the moving member 125 and the pair of hook members 136*a* are set on the brackets 137 symmetrically and swingable up and down through a pin 136*b* as a fulcrum. The inner end of each hook member 136*a* is connected to a projecting member 136*d* by way of a connecting member 136*c*. Two projecting members 136*d* are fixed on both sides of the rod 126*c* of the cylinder 126 and each outer end of the projecting members 136*d* is connected to the connecting member 136*c*. In each inside of an outer portion of the hook member 136*a* is fixed a protrusion 136*e* which is able to engage with the flange W2 of the spool. Slits 138*a* are provided in both sides of an upper portion of the cylindrical guide 138, through which the projecting member 136*d* protrude from the rod 126*c* outward. When the rod 126*c* is shortened by member of the cylinder 126, as shown in a left side of FIG. 38, each outer portion of the hook members 136*a* is pivoted inward on each pin 136*b* and each protrusion 136*e* is engaged with the flange W2 of the spool W so that the spool W is held. When the rod 126*c* is extended, as shown in a right side of FIG. 38, each outer portion of the hook members 136*a* is pivoted outward and each protrusion 136*e* is apart from the flange W2 so that the spool W is released from being held. Holding means with these hook members 136*a* of mechanism described above is preferably used for heavier spools, compared with the press-contact member 129.

In the above embodiment of the present invention, two takeout positions Y are provided along the transferring means 10. Two loading means 100 and two moving means 200 are set correspondingly to the two positions Y. However, it can be possible to change the number of loading means 100 and that of moving means 200 in accordance with the number of the creel stands S to be set. It can be enough to provide at least one takeout position Y, one loading means 100, one moving means 200, and one creel stand S.

Moreover, in the above embodiment, each spool box Wx storing spool-rows stacked in layers with the partitions Wz therebetween is supplied to the transferring means 10. However, when the creel stand S to which the spools W are fed is small, it can be also possible to supply each spool box Wx with one layer of spools in accordance with the scale of the creel stand. In this case, it is not necessary to provide the partition removing means 140. The transferring means 10 as described above comprises six conveyor systems 20, 30, 40, 50, 60 and 70, but these conveyor systems can be combined. For example, the second conveyor system 30 with correcting means 80 and the third conveyor system 40 with width positioning means 90 can be combined into one conveyor system.

As described above, the spool feeding method and spool feeder of the present invention make it possible to automate the step of feeding a plurality of spools stored in a spool box to remote creel stands. Therefore, it is possible to greatly improve the efficiency for feeding spools.

What is claimed is:

1. A spool feeder for feeding spools comprising:

at least one transferring means for transferring in a transfer direction to a spool takeout position a spool box having a plurality of spools with a cord wound on each of them, said spools being arranged with the axial direction of these spools kept in a height direction;

first holding means at the takeout position;

at least one loading means for unloading the spools from the spool box and loading the spools on said first holding means at the takeout position so that the axial direction of the spools is changed laterally from the height direction;

at least one moving means having said first holding means thereon for moving between a spool-receiving position and at least one creel stand; and setting means for setting the spools held by the first holding means on the moving means to creel shafts laterally set on the creel stand:

wherein the moving means has at least one first moving means running in a direction perpendicular to the transfer direction of the transferring means and at least second moving means for mounting the first moving means thereon and running in the transfer direction of the transferring means, the first moving means runs between a spool receiving position facing the loading means and a mounting position mounted on the second moving means and between a sending position for sending spools from the second moving means to the creel stand and a delivery position for delivering spools to the creel stand, and the second moving means runs between the mounting position and the sending position.

2. The spool feeder according to claim 1, wherein the loading means has at least one taking-out means for taking the spools out of the spool box and at least one removing means positioned at one side of the taking-out means for removing partitions present between the spools.

3. The spool feeder according to claim 2, wherein:

the taking-out means has a first moving section running on first guide rails extended in a direction perpendicular to the transfer direction of the transferring means on a support frame set above the transferring means and a holding section and having on the bottom thereof said first holding means, said first holding means being engageable with a longitudinal bore of a cylindrical portion of each spool, and the removing means has a second moving section running on the first guide rails and second holding means for sucking and holding a partition vertically movably set to the second moving section.

4. The spool feeder according to claim 1, wherein the transferring means has correcting means for correcting the inclination of the spool box so that it moves along the transfer direction and width positioning means for positioning the spool box in the cross direction perpendicular to the transfer direction.

5. The spool feeder according to claim 4, wherein the transferring means has a plurality of conveyor systems in series in the same transfer direction, each of which is arranged before the takeout position; each of the plurality of conveyor systems comprises a free roller conveyor having a plurality of freely rotating rollers for mounting the spool box and a chain conveyor having chains for transferring the spool box to be driven at both sides of the free roller conveyor, said rollers and said chains defining a transfer surface;

the correcting means has spool-box lifting means set to one of said conveyor systems and having mounting sections capable of rising above and retracting below the transfer surface between the chains of the chain conveyor and the free roller conveyor of one of said conveyor systems and a pair of pressing means for correcting the inclination of the spool box to the transfer direction by pressing both lateral sides of the spool box when the box is lifted by the lifting means; and the width positioning means is arranged on the downstream side, in the transfer direction, of said one of the conveyor systems with the correcting means, said width positioning means including a carriage arranged for reciprocating in a direction perpendicular to the transfer direction, and positioning means for positioning the spool box while on the conveyor system in a transfer width direction by moving the carriage.

6. The spool feeder according to claim 1, wherein the loading means has at least one taking-out means for taking the arranged spools out of the spool box to mount them on a mounting means and delivering means set to one side of the taking-out means and delivering the spools to the first holding means by rotating the mounting means.

7. The spool feeder according to claim 6, wherein:

the taking-out means has a first moving section running on first guide rails extended in a direction perpendicular to the transfer direction of the transferring means on a support frame set above the transferring means and a spool holding section vertically movably set on the moving section and having on the bottom thereof first spool holding means; and the delivering means has a rotating mechanism, the mounting means being set on the rotating mechanism, and a plurality of spool extruding means set to the mounting means, the mounting means has a mounting plate rotatable between a vertical position and a horizontal position, and a plurality of holding pins protruding on the surface of the mounting plate to hold each spool when the mounting plate, reaches said vertical position, and each extruding means has an extruding rod capable of rising above and retracting below the surface of the mounting plate.

8. The spool feeder according to claim wherein each first holding means has at least a horizontally protruding holding pin for holding spools, said pin being supported respectively on rotatable holding shafts arranged vertically.

9. The spool feeder according to claim 8, wherein each protruding holding pin is engageable with a longitudinal bore of a cylindrical portion of each spool to hold the spool.

10. The spool feeder according to claim 8, wherein each said first holding means has a pair of holding pins to hold a spool having two flanges by supporting the spool on both flanges.

11. The spool feeder according to claim 8, wherein the setting means has angle adjusting means for adjusting a protrusion angle of each holding pin by rotating the holding shafts and extruding means for extruding each spool held by the holding pin toward the creel stand.

12. The spool feeder according to claim 1, wherein collecting means for collecting empty spools is set between the creel stand and spool charging side of the transferring means.

13. The spool feeder according to claim 12, wherein the collecting means has transferring and collecting means for transferring the spool boxes storing empty spools to the spool charging side of transferring means and collecting them them and a plurality of carrying means for carrying the empty spools between the transferring and collecting means and the creel stand; the transferring and collecting means comprises a plurality of collecting conveyor systems set to a transfer side of the transferring means, a plurality of direction changing conveyor systems for connecting these collecting conveyor systems, and a further collecting conveyor system connected to one of the direction changing conveyor systems and extended to a charging port of the spool boxes; each carrying means has a plurality of freely rotating guide rollers supported on a carrying body in its cross direction to mount a spool box, a surface of the guide roller being kept approximately as high as the transfer surface of the collecting conveyor system; and guide rails capable of crossing a running route of the second moving means, when the carrying means crosses the running route, are movably provided on a transfer route of each carrying means.

14. A spool feeder for feeding spools comprising:

at least one transferring means for transferring in a transferring direction to a spool takeout position a spool box having a plurality of spools with a cord wound on each of them, said spools being arranged with the axial direction of these spools kept in a height direction;

first holding means at the takeout position;

at least one loading means for unloading the spools from the spool box and loading the spools on first holding means at the takeout position so that the axial direction of the spools is changed laterally from the height direction;

at least one moving means having said first holding means thereon for moving between a spool-receiving position and, at least one creel stand; and setting means for setting the spools held by the first holding means on the moving means to creel shafts laterally set on the creel stand;

wherein the transferring means has correcting means for correcting the inclination of the spool box so that it moves along the transfer direction and width positioning means for positioning the spool box in the cross direction perpendicular to the transfer direction; wherein;

the transferring means has a plurality of conveyor systems in series in the same transfer direction, each of which is arranged before the takeout position; each of the conveyor systems comprises a free roller conveyor having a plurality of freely rotating rollers for mounting the spool box and a chain conveyor having chains for transferring the spool box to be driven at both sides of the free roller conveyor, said rollers and said chains defining a transfer surface;

the correcting means has spool-box lifting means set to one of said conveyor systems and having mounting sections capable of rising above and retracting below the transfer surface between the chains of the chain conveyor and the free roller conveyor of one of said conveyor systems and a pair of pressing means for correcting the inclination of the spool box to the transfer direction by pressing both lateral sides of the spool box when the box is lifted by the lifting means; and the width positioning means is arranged on the downstream side, in the transfer direction, of said one of the conveyor systems with the correcting means, said width positioning means including a carriage arranged for reciprocating in a direction perpendicular to the transfer direction, and positioning means for positioning the spool box while on the conveyor system in a transfer width direction by moving the carriage.

15. A spool feeder for feeding spools comprising:

at least one transferring means for transferring in a transferring direction to a spool takeout position a spool box having a plurality of spools with a cord wound on each of them, said spools being arranged with the axial direction of these spools kept in a height direction;

a first holding means at the takeout position;

at least one loading means for unloading the spools from the spool box and loading the spools on said first holding means at the takeout position so that the axial direction of the spools is changed laterally from the height direction;

at least one moving means having said first holding means thereon for moving between a spool-receiving position and at least one creel stand; and setting means for setting the spools held by the first holding means on the moving means to creel shafts laterally set on the creel stand;

wherein collecting means for collecting empty spools is set between the creel stand and a spool charging side of the transferring means;

wherein the collecting means has transferring and collecting means for transferring the spool boxes storing empty spools to the spool charging side of transferring means and collecting them there and a plurality of carrying means for carrying the empty spools between the transferring and collecting means and the creel stand; the transferring and collecting means comprises a plurality of collecting conveyor systems set to a transfer side of the transferring means, a plurality of direction changing conveyor systems for connecting these collecting conveyor systems, and a further collecting conveyor system connected to one of the direction changing conveyor systems and extended to a charging port of the spool boxes; each carrying means has a plurality of freely rotating guide rollers supported on a carrying body in its cross direction to mount a spool box, a surface of the guide roller being kept approximately as high as the transfer surface of the collecting conveyor system; and guide rails capable of crossing a running route of the second moving means, when the carrying means crosses the running route, are movably provided on a transfer route of each carrying means.

16. A spool feeder for feeding spools comprising:

at least one transferring means for transferring in a transferring direction to a spool takeout position a spool box having a plurality of spools with a cord wound on each of them, said spools being arranged with the axial direction of these spools kept in a height direction;

a first holding means at the takeout position;

at least one loading means for unloading the spools from the spool box and loading the spools on said first holding means at the takeout position so that the axial direction of the spools is changed laterally from the height direction;

at least one moving means having said first holding means thereon for moving between a spool-receiving position and at least one creel stand; and setting means for setting the spools held by the first holding means on the moving means to creel shafts laterally set on the creel stand;

the loading means having at least one taking-out means for taking the arranged spools out of the spool box to mount them on a mounting means and delivering means set to one side of the taking-out means and delivering the spools to the first holding means by rotating the mounting means;

wherein:

the taking-out means has a first moving section running on first guide rails extended in a direction perpendicular to the transfer direction of the transferring means on a support frame set above the transferring means and a spool holding section vertically movably set on the moving section and having on the bottom thereof said first holding means, said first holding means capable of engaging a longitudinal bore of a cylindrical portion of each spool, and the delivering means has a rotating mechanism, the mounting means being set on the rotating mechanism, and a plurality of spool extruding means set to the mounting means, the mounting means has a mounting plate rotatable between a vertical position and a horizontal position, and a plurality of holding pins protruding on the surface of the mounting plate to hold each spool when the mounting plate reaches said vertical position, and each extruding means has an extruding rod capable of rising above and retracting below the surface of the mounting plate.

* * * * *